US005374295A

United States Patent [19]

Miura et al.

[11] Patent Number: 5,374,295

[45] Date of Patent: Dec. 20, 1994

[54] HEAT RESISTANT ALUMINUM ALLOY POWDER, HEAT RESISTANT ALUMINUM ALLOY AND HEAT AND WEAR RESISTANT ALUMINUM ALLOY-BASED COMPOSITE MATERIAL

[75] Inventors: Hirohisa Miura, Okazaki; Kunihiko Imahashi, Aichi; Yasuhiro Yamada, Tajimi; Hirohumi Michioka, Toyota; Jun Kusui, Youkaichi; Akiei Tanaka, Ohmihachiman, all of Japan

[73] Assignees: Toyota Jidosha Kabushiki Kaisha, Aichi; Toyo Aluminum Kabushiki Kaisha, Osaka, Japan

[21] Appl. No.: 26,150

[22] Filed: Mar. 3, 1993

[30] Foreign Application Priority Data

| | | | |
|---|---|---|---|
| Mar. 4, 1992 | [JP] | Japan | 4-047277 |
| Apr. 9, 1992 | [JP] | Japan | 4-089011 |
| Aug. 4, 1992 | [JP] | Japan | 4-208260 |
| Sep. 24, 1992 | [JP] | Japan | 4-279409 |
| Nov. 19, 1992 | [JP] | Japan | 4-358904 |
| Nov. 19, 1992 | [JP] | Japan | 4-358905 |
| Dec. 3, 1992 | [JP] | Japan | 4-324027 |

[51] Int. Cl.[5] ..... C22C 21/02

[52] U.S. Cl. ..... 75/244; 75/249; 148/437; 148/438; 419/5; 420/537; 420/538; 420/548; 420/550; 420/551; 420/552; 420/590

[58] Field of Search ..... 419/5; 420/590, 548, 420/537, 538, 550, 551, 552; 75/244, 249; 148/437, 438, 439, 440

[56] References Cited

U.S. PATENT DOCUMENTS

| | | | |
|---|---|---|---|
| 3,551,143 | 12/1970 | Marukawa et al. | 420/528 |
| 3,885,959 | 5/1975 | Badia et al. | 75/138 |
| 4,702,885 | 10/1987 | Odani et al. | 75/249 |
| 4,722,751 | 2/1988 | Akechi et al. | 75/244 |
| 4,943,413 | 7/1990 | Tank | 420/528 |
| 4,946,500 | 8/1990 | Zedalis et al. | 75/249 |
| 4,975,243 | 12/1990 | Scott et al. | 148/438 |
| 5,169,718 | 12/1992 | Miura et al. | 428/408 |

FOREIGN PATENT DOCUMENTS 0100470 2/1984 European Pat. Off. .

(List continued on next page.)

OTHER PUBLICATIONS

Chemical Abstracts, vol. 113, 1990, No. 116, 15 Oct. 1990, and JP-A-1 263 244, 19 Oct. 1989.

Patent Abstracts of Japan, vol. 13, No. 255 (C-606) Jun. 13, 1989 & JP-A-10-56 844 (Showa Denko K.K.) Mar. 3, 1989.

Chemical Abstracts of Japan, vol. 104, Columbus, Ohio, US; Abstract No. 73412, Komura, Katsuhiro et al., "Cast Aluminum Alloy Composites Containing Dispersed Ceramic Powder" & JP-A-60 159 137 (Hitachi, Ltd.) Aug. 20, 1985.

*Primary Examiner*—Richard O. Dean
*Assistant Examiner*—Robert R. Koehler
*Attorney, Agent, or Firm*—Finnegan, Henderson, Farabow, Garrett & Dunner

[57] ABSTRACT

Disclosed are heat resistant aluminum alloy powders and alloys including Ni, Si, either at least one of Fe and Zr or at least one of Zr and Ti. For instance, the alloy powders or alloys consist essentially of Ni in an amount of from 5.7 to 20% by weight, Si in an amount of from 0.2 to 25% by weight, at least one of Fe in an amount of from 0.6 to 8.0% by weight and Cu in an amount of from 0.6 to 5.0% by weight, and the balance of Al. The alloy powders or alloys are optimum for a matrix of heat and wear resistant aluminum alloy-based composite materials including at least one of nitride particles and boride particles in an amount of 0. 5 to 10% by weight with respect to the whole composite material taken as 100% by weight. The alloy powders, alloys and composite materials are satisfactory applicable to the component parts of the recent automobile engines which should produce a high output.

11 Claims, 6 Drawing Sheets

FOREIGN PATENT DOCUMENTS

| | | |
|---|---|---|
| 0113249 | 7/1984 | European Pat. Off. . |
| 0147769 | 7/1985 | European Pat. Off. . |
| 0196369 | 10/1986 | European Pat. Off. . |
| 0363225 | 4/1990 | European Pat. Off. . |
| 0366134 | 5/1990 | European Pat. Off. . |
| 0539172A1 | 4/1993 | European Pat. Off. . |
| 0561204A2 | 9/1993 | European Pat. Off. . |
| 59-13040 | 1/1984 | Japan . |
| 59-59855 | 4/1984 | Japan . |
| 60-50138 | 3/1985 | Japan . |
| 60-159137 | 8/1985 | Japan . |
| 64-56844 | 3/1989 | Japan . |
| 1-177340 | 7/1989 | Japan . |
| 1-247546 | 10/1989 | Japan . |
| 1-272741 | 10/1989 | Japan . |
| 2-129338 | 5/1990 | Japan . |
| 2-149629 | 6/1990 | Japan . |
| 2-149631 | 6/1990 | Japan . |
| 2-149632 | 6/1990 | Japan . |
| 2-149633 | 6/1990 | Japan . |
| 2-56401 | 11/1990 | Japan . |
| 3-291348 | 12/1991 | Japan . |
| 4-105787 | 4/1992 | Japan . |
| 4-173935 | 6/1992 | Japan . |
| 4-176836 | 6/1992 | Japan . |
| 4-202736 | 7/1992 | Japan . |
| 4-202737 | 7/1992 | Japan . |
| 4-311545 | 11/1992 | Japan . |
| 4-323343 | 11/1992 | Japan . |
| 5-5146 | 1/1993 | Japan . |
| 5-5147 | 1/1993 | Japan . |
| 90/02824 | 3/1990 | WIPO . |

HEAT RESISTANT ALUMINUM ALLOY POWDER, HEAT RESISTANT ALUMINUM ALLOY AND HEAT AND WEAR RESISTANT ALUMINUM ALLOY-BASED COMPOSITE MATERIAL

BACKGROUND OF THE INVENTION

The present invention relates to materials which are usefully applicable to engine component parts, such as pistons, connecting rods, intake valves, valve lifters, valve spring retainers, cylinder liners, and so on, of automobiles, aircrafts, or the like. In particular, it relates to an aluminum alloy powder, an aluminum alloy and an aluminum alloy-based composite material (hereinafter simply referred to as an "Al alloy-based MMC") which are excellent in the forgeability, the heat resistance, the strength at high temperatures, and the like.

DESCRIPTION OF THE RELATED ART

Aluminum alloys have been used as structural materials for aircrafts or automobiles for a long time, because they are light-weight and have a good processability. Among the conventional aluminum alloys, Al—Cu—Mg alloys set forth in JIS2024 and JIS2018 have been known that they have a good heat resistance.

In an aluminum alloy powder metallurgy symposium held by the Japan Light Metal Society on Mar. 9, 1987, an Al—Ni alloy was proposed which includes Ni in an amount of 5% by weight or more as set forth on pages 58 and 70 of the preprint. Unless otherwise specified, percentages (%) hereinafter mean % by weight.

Likewise, in Japanese Unexamined Patent Publication (KOKAI) No. 2-149,629, Japanese Unexamined Patent Publication (KOKAI) No. 2-149,631, Japanese Unexamined Patent Publication (KOKAI) No. 2-149,632 and Japanese Unexamined Patent Publication (KOKAI) No. 2-149,633, low thermal expansion aluminum alloys having a good wear resistance and thermal conductivity are disclosed which include an Al—Ni—Si—Cu—Mg alloy containing Ni in an amount of 8% or more and which are produced by casting process.

Further, in Japanese Examined Patent Publication (KOKOKU) No. 2-56,401, a heat resistant, wear resistant and high tensile aluminum alloy powder is disclosed which includes an Al—Ni—Si alloy powder containing Ni in an amount of from 7.7 to 15%, Si in an amount of from 15 to 25% and in which the Si crystals are 15 micrometers or less in the size.

Furthermore, as set forth on pages 11 through 34 of an "ALTOPIA" magazine Vol. 11, 1989, Al-Si(in high contents)-Fe alloys are used widely as heat resistant sintered aluminum alloys in general which contain Si in an amount of from 10 to 30%.

Recently, the automobile engines have been required to output a high motive power. Accordingly, the engine component parts, e.g., the connecting rods, or the like, are required to exhibit a tensile strength of 500 MPa or more at room temperature, a tensile strength of 450 MPa or more at 150° C., a tensile strength of 200 MPa at 300° C., and a yield strength of 180 MPa or more at 300° C. In particular, the valve lifters, the valve spring retainers, the cylinder liners, or the like, are required to exhibit a tensile strength of 450 MPa or more at 150° C.

In view of these requirements, the Al—Cu—Mg alloys set forth in JIS2024 and JIS2018 cannot be applied to the engine component parts of the recent automobiles despite their good tensile strength at room temperature, because they have tensile strengths of not more than 350, 300 and 150 MPa, respectively, at 150° C., at 200° C. and at 300° C.

Further, the Al—Ni alloy proposed in the symposium and the Al—Ni—Si—Cu—Mg alloy disclosed in the Japanese Unexamined Patent Publications cannot be applied to the recent engine component parts, either. Indeed, the Al—Ni alloy and the Al— Ni—Si—Cu—Mg alloy have an improved heat and wear resistance which results from the $NiAl_3$ intermetallic compounds generated in their metallographic structures. However, the alloys are processed into products by casting, and accordingly the $NiAl_3$ intermetallic compounds are enlarged to a grain size of about 10 micrometers in the products. As a result, the alloys were found to have a tensile strength of not more than 380 MPa at room temperature and a tensile strength degraded to 250 MPa and 160 MPa, respectively, at 150° C. and at 300° C. Additionally, the alloys cannot be applied to the engine component parts which are required to exhibit a good sliding characteristic, e.g., the valve lifters, the valve spring retainers, the cylinder liners, and so on, because they do not effect an appropriate wear resistance in the applications.

Furthermore, the Al—Ni—Si alloy disclosed in the Japanese Examined Patent Publication is processed into products by powder metallurgy process or sintering process. Namely, an alloy raw material having the predetermined composition is melted and atomized so as to produce the Al—Ni—Si alloy powder, and the resulting alloy powder is subjected to cold preliminary forming, extruding and forging in order to produce products. Thus, the $NiAl_3$ intermetallic compounds having a grain size of 4 micrometers or less arise from the alloy powder. Accordingly, the products are good in the wear resistance and they have a tensile strength of 510 MPa, 379 MPa and 345 MPa, respectively, at room temperature, 200° C. and 250° C. However, there are cases where some engine component parts cannot be produced with the alloy at an appropriate extrusion ratio (i. e., a ratio of cross-sectional areas before and after extrusion). Additionally, there are cases where the alloy suffers from the lack of strength and an inferior processability resulting from the high Si content.

Moreover, in order to use the sintered alloys as a raw material for products, the worst disadvantage of the sintered alloys, i.e., the brittleness, should be improved. For instance, the sintered alloys:are required to have a toughness, or an elongation of 0.4% or more and 2.5% or more, respectively, at room temperature and 300° C. In view of the brittleness requirement, the heat resistant sintered aluminum alloys, e.g., the Al—Ni—Si alloy and the Al—Si(in high contents)—Fe alloys, set forth in the Japanese Examined Patent Publication and the magazine are unsatisfactory in the toughness as well as the forgeability.

In addition, Japanese Unexamined Patent Publication (KOKAI) No. 2-129,338 discloses an MMC in which a reinforcing powder is dispersed in the matrix in order to improve the wear resistance. However, as set forth on pages 81 through 88 of report No. 25 (June, 1991) prepared by the research section of the research committee of the Japan Light Metal Society, the higher the conventional MMCs exhibit the strength at high temperatures, the lower they exhibit the forgeability or the elongation. In other words, the lower they exhibit the strength at high temperatures, the better they exhibit the forgeability.

Further, as set forth in the aforementioned magazine, on pages 48 through 53 of "KINZOKU" February, 1989 and Japanese Unexamined Patent Publication (KOKAI) No. 3-291,348, when the reinforcing powders or whiskers are dispersed in matrices having inappropriate components, the resulting MMCs come to exhibit a degraded strength at high temperatures.

Furthermore, as disclosed in Japanese Unexamined Patent Publication (KOKAI) No. 2-129,338, when Si is included in an amount of 20% or more, the conventional MMC with a good wear resistance comes to exhibit a deteriorated forgeability. Namely, the conventional MMCs, in which ceramics powders or fibers are dispersed, usually exhibit a high strength at high temperatures, but they exhibit an inferior forgeability or a low elongation.

Thus, in the conventional MMCs, the forgeability can be improved at the expense of the high strength at high temperatures. Accordingly, it is needed to select an appropriate matrix in order to simultaneously satisfy the high strength at high temperatures and the forgeability.

SUMMARY OF THE INVENTION

The present invention has been developed in view of the circumstances of the conventional alloys. It is therefore an object of the present invention to provide a heat resistant aluminum alloy powder, a heat resistant aluminum alloy and an Al alloy-based MMC which have an excellent toughness as well as an improved processability, especially, an improved forgeability. It is a further object of the present invention to provide a heat resistant aluminum alloy powder, a heat resistant aluminum alloy and a heat and wear resistant Al alloy-based MMC which can be stably processed into products having an excellent wear resistance and a superb strength at high temperatures.

The present inventors investigated aluminum alloys including Ni and Si in high contents, and they found that the aluminum alloys can be remarkably improved in the heat resistance by adding at least one of Fe and Cu thereto. They continued to investigate such aluminum alloys, and they found that the aluminum alloys can be made to have an exceptionally good toughness by reducing the Si content and the Fe and/or Cu content and by adding at least one of Zr and Ti because such aluminum alloys include the $NiAl_3$ compounds in a large amount in the matrices. They further continued an extensive research and development on such aluminum alloys, and they revealed that the aluminum alloys including Ni, Si and at least one of Fe and Cu usually contain Mg, and that Mg adversely affects the room and high temperature strengths. As a result, they completed a heat resistant aluminum alloy powder and a heat resistant aluminum alloy according to the present invention, and they verified that the present aluminum alloy powder and the present aluminum alloy are optimum as a matrix for a heat and wear resistant Al alloy-based MMC according to the present invention.

A heat resistant aluminum alloy powder according to the present consists essentially of Ni in an amount of from 5.7 to 20% by weight, Si in an amount of from 0.2 to 25% by weight, at least one of Fe in an amount of from 0.6 to 8.0% by weight and Cu in an amount of from 0.6 to 5.0% by weight, and the balance of Al.

The present heat resistant aluminum alloy powder can further include at least one of Zr in an amount of from 0.3 to 3.0% by weight and Ti in an amount of from 1.0 to 3.0% by weight.

The present heat resistant aluminum alloy powder can be modified so as to consist essentially of Ni in an amount of from 5.7 to 20% by weight, Si in an amount of from 6.0 to 15% by weight, at least one of Zr in an amount of from 0.3 to 3.0% by weight and Ti in an amount of from 0.3 to 3.0% by weight, and the balance of Al.

The thusly modified heat resistant aluminum alloy powder can further include at least one of Fe in an amount of from 0.6 to 5.0% by weight and Cu in an amount of from 0.6 to 5.0% by weight.

A heat resistant aluminum alloy according to the present invention consists essentially of Ni in an amount of from 5.7 to 20% by weight, Si in an amount of from 0.2 to 25% by weight, at least one of Fe in an amount of from 0.6 to 8.0% by weight and Cu in an amount of from 0.6 to 5.0% by weight, and the balance of Al.

The present heat resistant aluminum alloy can further include at least one of Zr in an amount of from 0.3 to 3.0% by weight and Ti in an amount of from 1.0 to 3.0% by weight.

The present heat resistant aluminum alloy can be modified so as to consist essentially of Ni in an amount of from 5.7 to 20% by weight, Si in an amount of from 6.0 to 15% by weight, at least one of Zr in an amount of from 0.3 to 3.0% by weight and Ti in an amount of from 0.3 to 3.0% by weight, and the balance of Al, and thereby the present aluminum alloy exhibits a tensile strength of 500 MPa or more and an elongation of 0.4% or more at room temperature, and a tensile strength of 200 MPa or more and an elongation of 5.0% or more at 300° C.

The thusly modified heat resistant aluminum alloy can further include at least one of Fe in an amount of from 0.6 to 5.0% by weight and Cu in an amount of from 0.6 to 5.0% by weight.

A heat and wear resistant Al alloy-based MMC according to the present invention comprises a matrix, and at least one of nitride particles and boride particles dispersed, with respect to the whole composite material including the matrix taken as 100% by weight, in the matrix in an amount of from 0.5 to 10% by weight, the matrix consisting, with respect to the matrix taken as 100% by weight, essentially of Ni in an amount of from 5.7 to 20% by weight, Si in an amount of from 0.2 to 25% by weight, at least one of Fe in an amount of from 0.6 to 8.0% by weight and Cu in an amount of from 0.6 to 5.0% by weight, and the balance of Al, and the Al alloy-based MMC formed by powder metallurgy process.

The present heat and wear resistant Al alloy-based MMC can further include, with respect to the matrix taken as 100% by weight, at least one of Zr in an amount of from 0.3 to 3.0% by weight and Ti in an amount of from 1.0 to 3.0% by weight.

The present heat and wear resistant Al alloy-based MMC can be modified so as to comprise a matrix, and at least one of nitride particles and boride particles dispersed, with respect to the whole composite material including the matrix taken as 100% by weight, in the matrix in an amount of from 0.5 to 10% by weight, the matrix consisting, with respect to the matrix taken as 100% by weight, essentially of Ni in an amount of from 10 to 20% by weight, Si in an amount of from 8.0 to 25% by weight, at least one of Fe in an amount of from 0.6 to 8.0% by weight and Cu in an amount of from 0.6 to 5.0% by weight, and the balance of Al, being substantially free from MMg, and the sum of Fe and Cu falling in a range of 10% by weight or less, and the Al alloy-based MMC formed by powder metallurgy process.

The thusly modified heat and wear resistant Al alloy-based MMC can further include, with respect to the matrix taken as 100% by weight, either Zr in an amount of from 0.3 to 2.0% by weight or Ti in an amount of from 1.0 to 4.0% by weight.

The present heat and wear resistant Al alloy-based MMC can be further modified so as to comprise a matrix, and at least one of nitride particles and boride particles dispersed, with respect to the whole composite material including the matrix taken as 100% by weight, in the matrix in an amount of from 0.5 to 10% by weight, the matrix consisting, with respect to the matrix taken as 100% by weight, essentially of Ni in an amount of from 5.7 to 20% by weight, Si in an amount of from 6.0 to 15% by weight, at least one of Zr in an amount of from 0.3 to 3.0% by weight and Ti in an amount of from 0.3 to 3.0% by weight, and the balance of Al, the Al alloy-based MMC formed by powder metallurgy process.

The thusly further-modified heat and wear resistant Al alloy-based MMC can further include, with respect to the matrix taken as 100% by weight, at least one of Fe in an amount of from 0.6 to 5.0% by weight and Cu in an amount of from 0.6 to 5.0% by weight.

The present heat resistant aluminum alloy powders can be produced by melting and spraying alloy materials having the above described compositions.

The present heat resistant aluminum alloys can be produced by making the present heat resistant aluminum alloy powders into alloys by powder metallurgy process or sintering process. For instance, the present heat resistant aluminum alloys can be produced as follows: The present heat resistant aluminum alloy powders are charged, respectively, in a case, they are cold-formed preliminarily while being kept in the state, they are then extruded, and finally they are forged into the present heat resistant aluminum alloys.

The present heat and wear resistant Al alloy-based MMCs can be produced as follows: At least one of nitride particles and boride particles are mixed with the present heat resistant aluminum alloy powders having the aforementioned compositions, and thereafter the mixture is processed by powder metallurgy process or sintering process.

The content ranges of the elements and the compounds, constituting the present heat resistant aluminum alloy powders, the present heat resistant aluminum alloys and the present heat and wear resistant Al alloy-based MMCs (hereinafter collectively referred to as the "present aluminum alloy materials"), will be hereinafter described along with the reasons for the limitations.

Ni: Ni is included in the present aluminum alloy materials in an amount of from 5.7 to 20%, preferably in an amount of from 10 to 20%, with respect to the matrix taken as 100%. Ni produces intermetallic compounds, such as $NiAl_3$, NiAl, $Ni_3Al$ and so on, together with Al. These intermetallic compounds are stable at high temperatures, and they contribute to the wear resistance and the high temperature strength. Particularly, the $NiAl_3$ intermetallic compound is less hard but tougher than the other intermetallic compounds, e.g., NiAl, $Ni_3Al$, and the like.

When Ni is included therein in an amount of 5.7% or more, there arises the precipitation of $NiAl_3$ intermetallic compound in the resulting present aluminum alloy materials. However, when Ni is included therein in an amount of less than 10%, the high temperature strength cannot be improved adequately for certain applications, for instance, the resulting present aluminum alloy materials might fail to exhibit a tensile strength of 200 MPa or more at 300° C.

When Ni is included therein in an amount of 40% or less, the resulting aluminum alloy materials form the $NiAl_3$ intermetallic compound. However, the aluminum alloy materials including Ni in an amount of more than 20% are brittle, and they exhibit an extremely small elongation at room temperature. As a result, when Ni is included therein in an amount of more than 20%, the resulting aluminum alloy materials cannot be used practically because of the remarkably deteriorated machinability, in spite of the good high temperature strength and wear resistance of products made therefrom. Thus, Ni is included in an amount of from 5.7 to 20% in the present aluminum alloy materials, preferably in an amount of from 10 to 20%, with respect to the matrix taken as 100%.

Si: Si is included in an amount of from 0.2 to 25% in the present aluminum alloy materials, and it can be included therein in an amount of from 0.2 to 15%, from 0.2 to 8.0% or from 8.0 to 25%, with respect to the matrix taken as 100%, depending on the applications.

It has been known that aluminum alloys with fine Si crystals dispersed therein, e.g., A390 alloy, are good in the high temperature strength and the wear resistance. In the case that products are made by casting aluminum alloys including Si in an amount of 11.3% or more, coarse Si primary crystals are precipitated therein. As a result, the resulting products attack their mating component part, and they also suffer from the considerably deteriorated machinability and elongation. Hence, they are not practical from the production engineering viewpoint, e.g., the cracks, or the like during the processing, and they might be even cracked during the service as component parts.

On the other hand, in the case that aluminum alloy materials are produced by rapid quenching and solidifying powder metallurgy process, the aluminum alloy materials can be obtained in which the fine Si crystals are precipitated even when Si is included therein in an amount of up to 25%, but they lack the heat resistance and the wear resistance when Si is included therein in an amount of less than 6.0%. Further, in the case that aluminum alloy materials are produced by rapid quenching and solidifying, the coarse Si crystals unpreferably precipitate in the products made from the aluminum alloy materials when Si is included therein in an amount of more than 25%. Accordingly, aluminum sintered alloys including Si in an amount of from 15 to 22% are used widely. However, according to the results of the experiments conducted by the present inventors, the resulting aluminum alloy materials suffer from an excessively deteriorated forgeability when Si is included therein excessively. Hence, it is preferable that Si is included therein as less as possible. Thus, Si is included therein in an amount of from 0.2 to 25%, and it can be included therein in an amount of from 0.2 to 15%, from 0.2 to 8.0% or from 8.0 to 25%, with respect to the matrix taken as 100%, depending on the applications.

Fe: Fe is included in the present aluminum alloy materials in an amount of from 0.6 to 8.0%, preferably in an amount of from 0.6 to 5.0%, with respect to the matrix taken as 100%. Fe is usually said that it is unpreferable to include Fe in aluminum alloy materials, and that Fe should be included therein in an amount of not more than 0.5%. However, according to the results of the experiments conducted by the present inventors, it was revealed that the resulting aluminum alloy materials can be improved in the strength at room temperature and the high temperature strength at 300° C. when Fe is included therein.

When Fe is included therein in an amount of less than 0.6%, the resulting aluminum alloy materials are improved less effectively in the strength at room temperature and the high temperature strength at 300° C. When Fe is included therein in an amount of more than 8.0%, the resulting aluminum alloy materials are brittle, and the forgeability degrades. In addition, the resulting aluminum alloy materials can be effectively improved in the room temperature strength by including at least one of Fe and Cu described below, and the sum of Fe and Cu preferably falls in a range of 10% or less, further preferably in a range of from 2 to 10%.

Cu: Cu is included in the present aluminum alloy materials in an amount of from 0.6 to 5.0% with respect to the matrix taken as 100%. Cu age-hardens aluminum alloy material, thereby reinforcing the matrix.

When Cu is included therein in an amount of 0.6% or more, the resulting aluminum alloy materials are improved in the strength at room temperature effectively. When Cu is included therein in an amount of mope than 5.0%, the resulting aluminum alloy materials are degraded in the high temperature strength at 300° C. because coarse precipitates arise therein. Thus, Cu is included therein in an amount of from 0.6 to 5.0% with respect to the matrix taken as 100%. In addition, the resulting aluminum alloy materials can be effectively improved in the room temperature strength by including at least one of Fe described above and Cu, and the sum of Fe and Cu preferably falls in a range of 10% or less, further preferably in a range of from 2 to 10%.

Zr: Zr is included in the present aluminum alloy materials in an amount of from 0.3 to 3.0%, preferably in an amount of from 0.3 to 2.0%, with respect to the matrix taken as 100%. Zr has been known that it is one of additive elements which can improve the strength at high temperatures. Moreover, according to the results of the experiments conducted by the present inventors, it was verified that the resulting aluminum alloy materials can be improved in the elongations at room temperature and at 300° C. by including Zr, and that Zr does not damage the forgeability. Hence, the resulting aluminum alloy materials are effectively enhanced in the toughness. Additionally, the present inventors also found that the resulting aluminum alloy materials including Zr are less likely to exhibit the degraded strength after it is subjected to high temperatures for a long period of time.

When Zr is included therein in an amount of less than 0.3%, the resulting aluminum alloy materials are improved less effectively in the toughness. When Zr is included therein in an amount of more than 3.0%, coarse intermetallic compounds like $ZrAl_3$ are precipitated therein unpreferably. Thus, Zr is included therein in an amount of from 0.3 to 3.0%, preferably in an amount of from 0.3 to 2.0%, with respect to the matrix taken as 100%. In addition, the resulting aluminum alloy materials can be effectively improved in the toughness by including at least one of Zr and Ti described below, and the sum of Ni, Zr and Ti preferably falls in a range of from 8.0 to 18% so that the physical properties of the resulting aluminum alloy materials fluctuate less.

Ti: Ti is included in the present aluminum alloy materials in an amount of from 0.3 to 4.0%, and it can be included therein in an amount of from 0.3 to 3.0%, from 1.0 to 3.0% or from 1.0 to 4.0%, with respect to the matrix taken as 100%, depending on the applications. Ti has been also known that it is one of additive elements which can improve the strength at high temperatures. Moreover, according to the results of the experiments conducted by the present inventors, it was revealed that the resulting aluminum alloy materials can be improved in the yield strength at at 300° C. by including Ti, and that Ti does not damage the forgeability.

When Ti is included therein in an amount of less than 0.3%, the resulting aluminum alloy materials are improved less effectively in the yield strength at high temperatures. When Ti is included therein in an amount of more than 4.0%, the molten metal of the resulting aluminum alloy materials exhibits an increasing viscosity, and the resulting aluminum alloy materials are deteriorated in the toughness disadvantageously. Thus, Ti is included therein in an amount of from 0.3 to 4.0% with respect to the matrix taken as 100%. In addition, the resulting aluminum alloy materials can be effectively improved in the toughness by including at least one of Zr described above and Ti, and the sum of Ni, Zr and Ti preferably falls in a range of from 8.0 to 18% so that the physical properties of the resulting aluminum alloy materials fluctuate less.

Mg: It is preferred that the present aluminum alloy materials are substantially free from Mg. In general, Mg has been known that, similarly to Cu, it is one of additive elements which reinforce the matrix. However, according to the results of the experiments conducted by the present inventors, it was verified that the resulting aluminum alloy materials including Mg are deteriorated in both of the strengths and elongations at room temperature and at 300° C. when their strength and elongation characteristics are compared with those of the aluminum alloy materials free from Mg.

Here, Japanese Examined Patent Publication (KOKOKU) No. 63-20,298 discloses an aluminum alloy which includes Ni, Si, at least one of Cu and Mg, and the balance of Al. However, this publication does not set forth any preferred embodiment which does not include Mg but includes Cu, and it does not at all suggest that Mg adversely affects the strengths at room temperature and at high temperatures.

O: It is preferred that the present aluminum alloy materials includes O in an amount of from 0.05 to 0.40%. Generally speaking, O damages the strength, the elongation, and the like of the heat resistant aluminum alloy materials. However, the experiments conducted by the present inventors revealed that the physical properties of the present aluminum alloy materials are not adversely affected substantially when O is included therein in an amount of 0.40% or less.

Therefore, in the case that the present heat resistant aluminum alloy powder is produced by atomizing in a non-oxidizing atmosphere, and that the resulting present heat resistance aluminum alloy powder is sealed in a can and thereafter extruded to blanks even in an oxidizing atmosphere, the content of O can be reduced to less than 0.05% in the blanks. Here, a strict process control is usually required for the production process of the conventional heat resistant aluminum alloy materials in order to reduce the oxygen content to less than 0.10% therein. However, it should be noted that a relatively large oxygen content, e.g., not more than 0.40%, can be permitted in the present heat resistant aluminum alloy materials. Accordingly, the present heat resistant aluminum alloy materials can be produced with ease, and the production process can be simplified.

Mo: Mo can be included in the present aluminum alloy materials in an amount of 2.0% or less. Mo has been known as one of the additives which improve the heat resistance. Still, according to the results of the experiments conducted by the present inventors, Mo remarkably contributes to the improvements in the rigidity and the creep strength of aluminum alloys. However, when Mo is included therein in an excessive amount, the resulting aluminum alloy materials are degraded in the forgeability. Accordingly, it is preferred that Mo is included therein in an amount of 2.0% or less.

Nitride particles and Boride particles: In particular, in order to improve the wear resistance of the present aluminum alloy materials, the present heat and wear resistant Al alloy-based MMCs include at least one of nitride particles and boride particles which are dispersed, with respect to the whole MMCs including the matrix taken as 100%, in the matrix in an amount of from 0.5 to 10%. When the nitride particles, the boride particles or the mixture are dispersed therein in an amount of less than 0.5%, no advantageous effect results from the dispersion. When the nitride particles, the boride particles or the mixture are dispersed therein in an amount of more than 10%, the resulting Al alloy-based MMCs unpreferably exhibit a sharply decreased tensile strengths, elongations and the machinability.

The nitride particles can be AlN, TiN, ZrN, BN particles, or the like, and the boride particles can be $TiB_2$, NiB, $MgB_2$ particles, or the like. It is preferred that the nitride and boride particles are fine particles having an average particle diameter of from 0.2 to 20 micrometers, further preferably from 0.5 to 20 micrometers, or furthermore preferably from 1.0 to 20 micrometers. When the average particle diameter is less than 0.2 micrometers, the resulting Al alloy-based MMCs exhibit degraded mechanical properties because the nitride and boride particles aggregate, or because they are segregated in the grain boundaries. When the average particle diameter is more than 20 micrometers, the resulting Al alloy-based MMCs are improved less in the wear resistance because the nitride and boride particles break or come off.

All in all, when the present aluminum alloy materials are used to make the engine component parts of automobiles, or the like, they can make the engine component parts which securely satisfy the high output requirement in the recent automobile engines, because not only they are light-weight but also they stably exhibit the superb wear resistance, rigidity, thermal expansion characteristic, room temperature strength, high temperature strength, toughness and forgeability.

In addition, although some of the present aluminum alloy materials include Fe in the relatively large amount, they stably exhibit the superb wear resistance, rigidity, thermal expansion characteristic, room temperature strength and high temperature strength. Consequently, even if aluminum component parts and iron component parts are mixed and scrapped in a recycle process, the present aluminum alloy materials can be re-produced with ease in the recycle process.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
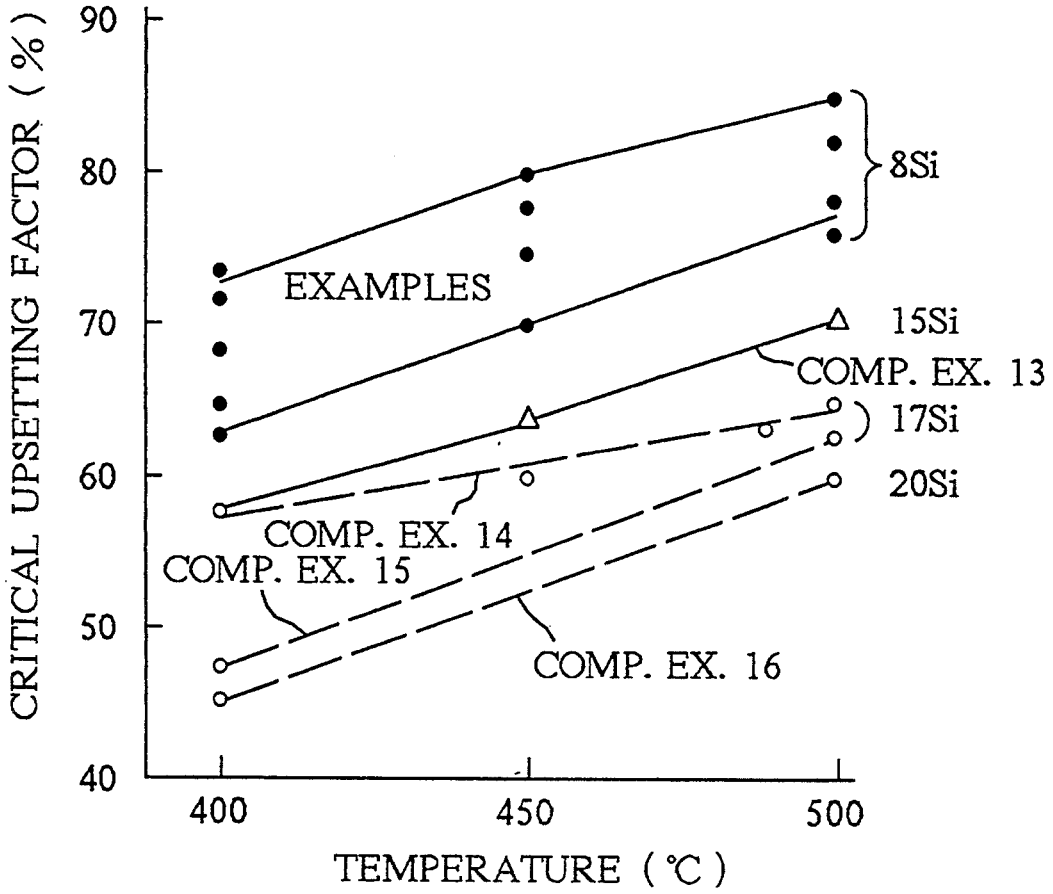
FIG. 1 is a graph illustrating the relationships between temperatures and critical upsetting factors which were exhibited by preferred embodiments of the present invention and comparative examples in Evaluation No. 2.

Having generally described the present invention, a further understanding can be obtained by reference to the specific preferred embodiments which are provided herein for purposes of illustration only and are not intended to limit the scope of the appended claims.

First Preferred Embodiments

First Preferred Embodiments of the present invention, e.g., Example Nos. 1 through 7, will be hereinafter described with reference to Tables 1 and 2 below and FIGS. 1 and 2, along with Comparative Example Nos. 1 through 12.

Molten metals having compositions set forth in Table 1 were pulverized by atomizing process, and the resulting powders were classified with a minus 100 mesh sieve, respectively. Heat resistant aluminum alloy powders of Example Nos. 1 through 7 and Comparative Example Nos. 1 through 12 were thus prepared.

The resulting heat resistant aluminum alloy powders were charged in a tube which was bottomed with pure aluminum, and they are cold-formed preliminarily into a preform having a diameter of 20 mm and a length of 80 mm, respectively, with a surface pressure of 3 ton/cm$^2$ in vacuum. The preforms were heated at 450° C. for 30 minutes, and they are hot-extruded at a relatively large extrusion ratio of 10. Heat resistant aluminum alloys of Example Nos. 1 through 7 and Comparative Example Nos. 1 through 12 were thus prepared in a rod having a diameter of 10 mm.

TABLE 1

| | COMPOSITION (%) | R.T. | | | 150° C. | | | 300° C. | | |
|---|---|---|---|---|---|---|---|---|---|---|
| | | T.S. | Y.S. | δ | T.S. | Y.S. | δ | T.S. | Y.S. | δ |
| Ex. 1 | Al-14Ni-8Si-1Zr-3Cu | 629 | 530 | 1.2 | 486 | 405 | 3.4 | 225 | 179 | 9.6 |
| Ex. 1 | Al-14Ni-8Si-1Zr-3Cu | 561 | 546 | 0.8 | 486 | 395 | 3.0 | 217 | 169 | 10.0 |
| Ex. 2 | Al-11Ni-8Si-3Fe-1Zr-3Cu | 676 | 586 | 0.7 | 546 | 457 | 1.8 | 244 | 182 | 7.8 |
| Ex. 2 | Al-11Ni-8Si-3Fe-1Zr-3Cu | 665 | 572 | 0.5 | 515 | 468 | 0.8 | 240 | 177 | 6.8 |
| Ex. 3 | Al-13Ni-8Si-1Mo-1Zr-3Cu | 603 | 577 | 0.4 | 502 | 431 | 1.4 | 229 | 185 | 8.8 |
| Ex. 3 | Al-13Ni-8Si-1Mo-1Zr-3Cu | 577 | 551 | 0.5 | 486 | 426 | 1.0 | 227 | 187 | 9.2 |
| Ex. 4 | Al-13Ni-8Si-2Ti-3Cu | 616 | 603 | 0.4 | 514 | 442 | 1.4 | 248 | 195 | 7.4 |
| Ex. 5 | Al-10Ni-8Si-3Fe-2Ti-3Cu | 653 | 612 | 0.4 | 531 | 470 | 0.9 | 286 | 208 | 5.6 |
| Ex. 6 | Al-14Ni-12Si-3Cu-1Zr | 556 | 531 | 0.5 | 471 | 437 | 1.2 | 231 | 180 | 5.5 |
| Ex. 7 | Al-12Ni-12Si-2Ti-1zr | 530 | 503 | 0.6 | 468 | 434 | 1.3 | 251 | 198 | 5.8 |
| C.E. 1 | Al-25Ni-8Si-1Cu | 507 | — | — | 431 | — | — | 291 | 231 | 0.8 |
| C.E. 2 | Al-20Ni-15Si-1Fe | 534 | — | — | 449 | — | — | 303 | 206 | 2.1 |
| C.E. 3 | Al-15Ni-25Si | 457 | — | — | 415 | — | — | 288 | 196 | 1.6 |
| C.E. 4 | Al-15Ni-20Si | 460 | — | — | 418 | — | — | 288 | 188 | 2.0 |
| C.E. 5 | Al-15Ni-20Si-3Cu | 569 | — | — | 484 | 472 | 0.3 | 250 | 164 | 4.0 |
| C.E. 6 | Al-15Ni-15Si-3Cu | 554 | — | — | 486 | 486 | 0.2 | 294 | 191 | 3.2 |
| C.E. 7 | Al-15Ni-15Si-3Cu-2Mg | 536 | — | — | 473 | — | — | 265 | 180 | 2.4 |
| C.E. 8 | Al-10Ni-25Si-1Cu | 514 | — | - | 445 | — | — | 290 | 233 | 0.9 |
| C.E. 9 | Al-10Ni-12Si-7Fe | 585 | — | — | 514 | — | — | 255 | 226 | 1.0 |
| C.E. 10 | Al-10Ni-20Si | 468 | 432 | 0.5 | | | | 196 | 152 | 6.0 |
| C.E. 11 | Al-10Ni-15Si | 496 | 404 | 1.5 | | | | 177 | 148 | 9.6 |
| C.E. 12 | Al-10Ni-10Si | 469 | 354 | 2.6 | | | | 160 | 133 | 12.9 |

(Note)
R.T.: Room Temperature, T.S.: Tensile Strength (MPa), Y.S.: Yield Strength (MPa), & δ: Elongation (%)

Evaluation No. 1

Example Nos. 1 through 7 and Comparative Example Nos. 1 through 12 were examined for the strength characteristics, e.g., the tensile strength, the yield strength and the elongations, and the results of the examinations are set forth in Table 1 together with the compositions.

As can be appreciated from Table 1, all of Example Nos. 1 through 7 exhibited a tensile strength of more than 500 MPa at room temperature, and they were thus superb in the room temperature strength. Further, all of Example Nos. 1 through 7 exhibited a tensile strength of more than 200 MPa at 300° C., and they were thus superior in the high temperature strength, too. Furthermore, in spite of these excellent strength characteristics, all of Example Nos. 1 through 7 exhibited an elongation of 0.4% or more and more than 5.0%, respectively, at room temperature and at 300° C., and they had a fuller toughness which had not been expected from the conventional aluminum sintered alloys.

In addition, the heat resistant aluminum alloy of Example No. 7 including Zr and Ti exhibited a yield strength of 200 MPa approximately and an elongation of 6.0% approximately at 300° C. Thus, one can expect that it is utilized as a heat resistant aluminum alloy having an excellent forgeability.

Evaluation No. 2

The following 9 sintered heat resistant aluminum alloys were machined to a test piece "T/P" having a diameter of 10 mm and a length of 15 mm, respectively, in a quantity of from 5 to 8: Example Nos. 1 through 5 and Comparative Example Nos. 13 through 16 whose compositions are set forth in Table 2 below and which were prepared as described above.

Figure 2:
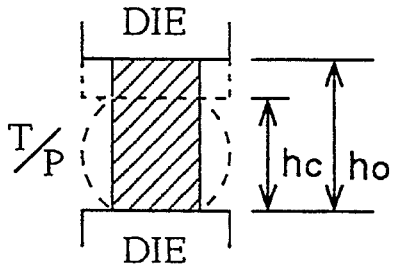
FIG. 2 is a schematic cross-sectional view illustrating a way of the measurement for the critical upsetting factors in Evaluation Nos. 2 and 20.

Then, as illustrated in FIG. 2, the test pieces "T/P" were held between dies, and they were subjected to an upsetting test in a temperature range of from 400° to 500° C. for examining the critical upsetting factor ($\epsilon_{hc}$ in %). The upsetting test was carried out at an upsetting speed of 70 mm/second while varying the upsetting factor. Here, the critical upsetting factor ($\epsilon_{hc}$ in %) was calculated in accordance with the following equation:

$$\epsilon_{hc}=\{(h_o-h_c)/h_o\}\times 100.$$

The results of the upsetting test are illustrated in FIG. 1, and the critical upsetting factors at 450° C. are set forth in Table 2 together with the compositions of the 9 sintered heat resistance aluminum alloys. Here, please note that the sum of Ni, Fe, Mo, Zr and Ti was adapted to 15% in all of the compositions of Examples Nos. 1 through 5.

TABLE 2

| | COMPOSITION (%) | C.U.F. (%) |
|---|---|---|
| Ex. 1 | Al-14Ni-8Si -1Zr-3Cu | 80.2 |
| Ex. 2 | Al-11Ni-8Si-3Fe-1Zr-3Cu | 68.3 |
| Ex. 3 | Al-13Ni-8Si-1Mo-1Zr-3Cu | 75.5 |
| Ex. 4 | Al-13Ni-8Si -2Ti-3Cu | 79.4 |
| Ex. 5 | Al-10Ni-8Si-3Fe-2Ti-3Cu | 71.5 |
| C. E. 13 | Al-15Ni-15Si-1Fe -3Cu | 63.2 |
| C. E. 14 | Al -17Si-7Fe -3Cu | 59.5 |
| C. E. 15 | Al-17Si-15Ni-1Fe -3Cu | 54.0 |
| C. E. 16 | Al-20Si-15Ni-1Fe | 52.1 |

(Note)
C. U. F.: Critical Upsetting Factor (%)

As can be seen from FIG. 1 and Table 2, Example Nos. 1 through 5 substantially exhibited a critical upsetting factor of more than 70% approximately, and they were thus superior in the forgeability. As can be appreciated from FIG. 1, the forgeability depended on the Si content greatly. Turning now to Table 2, from the comparisons between Example Nos. 1 and 2, Example Nos. 4 and 5, and Comparative Example Nos. 14 and 15, it also depended on the Fe content considerably.

As having been detailed so far, since Example Nos. 1 through 7 of the present heat resistant aluminum alloys included Ni, Si, and Zr and/or Ti in the predetermined amount, not only they were light-weight, but also they exhibited the superb toughness and the improved forgeability which were optimum for product materials.

In particular, in addition to the aforementioned advantageous effects, Example Nos. 1 through 6 including Fe and/or Cu in the predetermined amount exhibited further enhanced wear resistance and room and high temperature strengths.

more than 500 MPa, respectively, at room temperature and at 150° C., and they were thus especially superior in the room and high temperature strength.

TABLE 3

| | COMPOSITION (%) | R.T. T.S. | 150° C. T.S. | 150° C. Y.S. | 150° C. δ | 300° C. T.S. | 300° C. Y.S. | 300° C. δ |
|---|---|---|---|---|---|---|---|---|
| Ex. 8 | Al-10Ni-8Si-3Fe-3Cu-1Zr-1Ti | 634 | 530 | 468 | 1.4 | 220 | 174 | 3.6 |
| Ex. 8 | Al-10Ni-8Si-3Fe-3Cu-1Zr-1Ti | 621 | 509 | 442 | 1.2 | 218 | 169 | 3.8 |
| Ex. 9 | Al-10Ni-8Si-3Fe-3Cu-2Ti | 683 | 533 | 473 | 0.8 | 286 | 208 | 5.6 |
| Ex. 9 | Al-10Ni-8Si-3Fe-3Cu-2Ti | 535 | 528 | 468 | 0.8 | 278 | 208 | 5.4 |
| Ex. 10 | Al-11Ni-8Si-3Fe-3Cu-1Zr | 676 | 546 | 457 | 1.8 | 244 | 182 | 6.8 |
| Ex. 10 | Al-11Ni-8Si-3Fe-3Cu-1Zr | 665 | 515 | 468 | 0.8 | 240 | 177 | 5.8 |
| Ex. 11 | Al-12Ni-8Si-3Fe-3Cu | 681 | 556 | 499 | 1.4 | 282 | 192 | 6.8 |
| Ex. 11 | Al-12Ni-8Si-3Fe-3Cu | 650 | 533 | 483 | 0.6 | 265 | 185 | 5.8 |
| Ex. 12 | Al-12Ni-3Si-3Fe-3Cu-1Zr-1Ti | 631 | 530 | 437 | 1.6 | 213 | 172 | 3.4 |
| Ex. 12 | Al-12Ni-3Si-3Fe-3Cu-1Zr-1Ti | 613 | 517 | 431 | 2.0 | 200 | 161 | 3.0 |
| Ex. 13 | Al-10Ni-3Si-3Fe-3Cu-1Zr-1Ti | 598 | 476 | 390 | 4.4 | 208 | 169 | 3.8 |
| Ex. 13 | Al-10Ni-3Si-3Fe-3Cu-1Zr-1Ti | 585 | 473 | 405 | 5.4 | 194 | 156 | 4.0 |
| Ex. 14 | Al-12Ni-0.5Si-3Fe-3Cu-1Zr-1Ti | 702 | 520 | 416 | 4.2 | 200 | 156 | 5.4 |
| Ex. 14 | Al-12Ni-0.5Si-3Fe-3Cu-1Zr-1Ti | 657 | 520 | 411 | 5.4 | 195 | 151 | 5.2 |
| Ex. 15 | Al-10Ni-0.5Si-3Fe-3Cu-1Zr-1Ti | 668 | 496 | 411 | 5.4 | 192 | 156 | 4.4 |
| Ex. 15 | Al-10Ni-0.5Si-3Fe-3Cu-1Zr-1Ti | 644 | 481 | 400 | 3.6 | 172 | 148 | 3.8 |
| Ex. 16 | Al-11Ni-8Si-3Fe-1Cu-1Zr | 624 | 489 | 405 | 3.0 | 199 | 151 | 6.4 |
| Ex. 16 | Al-11Ni-8Si-3Fe-1Cu-1Zr | 613 | 470 | 426 | 1.2 | 191 | 143 | 5.6 |
| Ex. 17 | Al-12Ni-8Si-2Fe-2Cu-1Zr | 587 | 489 | 437 | 1.2 | 205 | 151 | 4.4 |
| Ex. 17 | Al-12Ni-8Si-2Fe-2Cu-1Zr | 585 | 478 | 426 | 1.2 | 204 | 153 | 4.4 |
| Ex. 18 | Al-12.5Ni-8Si-1.5Fe-1Cu-1Zr | 590 | 476 | 419 | 0.8 | 237 | 185 | 4.0 |
| Ex. 18 | Al-12.5Ni-8Si-1.5Fe-1Cu-1Zr | 563 | 464 | 421 | 0.8 | 176 | 135 | 3.4 |
| Ex. 19 | Al-10Ni-12Si-7Fe | 616 | 520 | — | — | 294 | 213 | 1.2 |
| Ex. 19 | Al-10Ni-12Si-7Fe | 554 | 507 | — | — | 296 | 239 | 0.8 |
| Ex. 20 | Al-12Ni-12Si-3Fe-2Cu-1Zr | 564 | 486 | — | — | 281 | 223 | 2.0 |
| C. E. 17 | Al-15Ni-25Si | 457 | 415 | — | — | 288 | 196 | 1.6 |
| C. E. 17 | Al-15Ni-25Si | 454 | 368 | — | — | — | — | — |
| C. E. 18 | Al-15Ni-20Si | 460 | 418 | — | — | 288 | 188 | 2.0 |
| C. E. 18 | Al-15Ni-20Si | 505 | 469 | 469 | 0.2 | 274 | 181 | 2.9 |
| C. E. 19 | Al-10Ni-20Si | 475 | 432 | 397 | 2.4 | 199 | 155 | 5.0 |
| C. E. 19 | Al-10Ni-20Si | 457 | — | — | — | 192 | 148 | 6.9 |
| C. E. 20 | Al-12Ni-15Si-3Fe | 535 | 499 | — | — | 320 | 281 | 0.8 |
| C. E. 20 | Al-12Ni-15Si-3Fe | 486 | 478 | — | — | 307 | 249 | 1.0 |
| C. E. 21 | Al-10Ni-15Si | 500 | 462 | 415 | 3.7 | 186 | 158 | 9.4 |
| C. E. 21 | Al-10Ni-15Si | 491 | — | — | — | 168 | 138 | 9.8 |
| C. E. 22 | Al-10Ni-10Si | 473 | 429 | 393 | 4.5 | 164 | 135 | 12.8 |
| C. E. 22 | Al-10Ni-10Si | 465 | — | — | — | 156 | 131 | 13.0 |
| C. E. 23 | Al-25Ni-8Si-1Cu | 507 | 473 | — | — | 278 | 239 | 0.6 |
| C. E. 23 | Al-25Ni-8Si-1Cu | 507 | 447 | — | — | 304 | 223 | 1.0 |
| C. E. 24 | Al-12Ni-12Si-2Ti-1Zr | 530 | 468 | 434 | 1.3 | 251 | 198 | 5.8 |
| C. E. 24 | Al-12Ni-12Si-2Ti-1Zr | 494 | 473 | 437 | 0.4 | 249 | 192 | 2.8 |

(Note)
R.T.: Room Temperature, T.S.: Tensile Strength (MPa), Y.S.: Yield Strength (MPa), & δ: Elongation

Second Preferred Embodiments

Second Preferred Embodiments of the present invention, e.g., Example Nos. 8 through 20, will be hereinafter described with reference to Tables 3 and 4, along with Comparative Example Nos. 17 through 24.

Example Nos. 8 through 20 and Comparative Example Nos. 17 through 24 were prepared in the same manner as set forth in the "First Preferred Embodiment" section, and they were subjected to the following 5 evaluations, e.g., Evaluation Nos. 3 through 7.

Evaluation No. 3

Example Nos. 8 through 20 and Comparative Example Nos. 17 through 24 were examined for the strength characteristics, e.g., the tensile strength, the yield strength and the elongations, and the results of the examinations are set forth in Table 3 together with the compositions.

As can be appreciated from Table 3, all of Example Nos. 8 through 20 exhibited a tensile strength of more than 550 MPa and more than 450 MPa, respectively, at room temperature and at 150° C., and they were thus superb in the room and high temperature strength. In particular, Example Nos. 8 through 11 substantially exhibited a tensile strength of more than 600 MPa and On the other hand, all of Comparative Example Nos. 17 through 24, which did not include either at least of one of Fe and Cu or at least one of Zr and Ti, exhibited a tensile strength of less than 550 MPa at room temperature, and they were inferior to those of Examples 8 through 20 in the tensile strength at room temperature.

Moreover, Example Nos. 13 through 15, which included Si in the relatively small amount, exhibited an exceptionally good tensile strength and elongation, respectively, at room temperature and at 150° C.

Evaluation No. 4

The following 2 heat resistant aluminum alloys, e.g., Example Nos. 9 and 11, which were made from Al—10Ni—8Si—3Fe3Cu—2Ti and Al—12Ni—8Si—3Fe—3Cu aluminum alloy powders, respectively, as set forth in the "First Preferred Embodiment" section, were subjected to a rotary flexure test, and they are examined for the fatigue resistances (in MPa) at room temperature and at 150° C. The results of the rotary flexure test are set forth in Table 4 below.

TABLE 4

| Test Specimen | Fatigue Resistance At Room Temperature | (MPa) At 150° C. |
|---|---|---|
| Ex. No. 9 | 270 | 196 |
| Ex. No. 11 | 267 | 206 |

As can be apparent from Table 4, both of Example Nos. 9 and 11 exhibited a fatigue resistance of 196 MPa or more, and they were thus satisfactory in the fatigue resistance as well.

Evaluation No. 5

In certain production processes, sintered aluminum alloys are left at high temperatures for a long period of time. In such production processes, one might afraid that the grains become coarse so as to degrade the strength. Therefore, Example Nos. 8 through 11 were examined for the strength and the reduction rate after they were left at high temperatures for a long period of time. Namely, Example Nos. 8 through 11 were heated to 450° C. for 10 hours, and they were left at the temperature for 2 hours. The results of the evaluation are set forth in Table 5 below.

Example Nos. 8 through 10, which included at least one of Zr and Ti, exhibited the reduction rate of from 3.4 to 5.4% at room temperature or at 150° C. Example No. 11, which were free from Zr and Ti, exhibited the slightly higher reduction rate of 7.5% and 8.6%, respectively, at room temperature and at 150° C., but it still exhibited an exceptionally good strength of 498 MPa even after it was left at the high temperatures.

TABLE 5

Strength & Reduction Rate after Left at High Temperatures
Exs. 8–11 were heated to 450° C. for 10 hours and left at the temperature for 2 hours.

| | COMPOSITION (%) | Strength (after, MPa) R.T. | Strength (after, MPa) 150° C. | Reduc. Rate (%) R.T. | Reduc. Rate (%) 150° C. |
|---|---|---|---|---|---|
| Ex. 8 | Al-10Ni-8Si-3Fe-3Cu-1Zr-1Ti | 603, 587 χ: 595 | 494, 489 χ: 492 | 5.3 | 5.4 |
| Ex. 9 | Al-10Ni-8Si-3Fe-3Cu-2Ti | 603, 561 χ: 582 | 520, 499 χ: 510 | 4.4 | 4.0 |
| Ex. 10 | Al-11Ni-8Si-3Fe-3Cu-1Zr | 647, 629 χ: 638 | 512, 496 χ: 504 | 3.4 | 5.1 |
| Ex. 11 | Al-12Ni-8Si-3Fe-3Cu | 624, 608 χ: 616 | 504, 491 χ:498 | 7.5 | 8.6 |

(Note)
R.T.: Room Temperature
Table 5 summarizes variations before and after the heat treatment.

Evaluation No. 6

Example Nos. 8 through 11 were examined for the rigidity, e.g., the Young's modulus. Here, please note that the sum of Ni, Zr and Ti was adapted to 12% in all of the compositions of Examples Nos. 8 through 11. With this composition arrangements, the Young's modulus exhibited by Example Nos. 8 through 11 fluctuated less, for instance, it fell in a range of from 110 to 115 GPa. Thus, Example Nos. 8 through 11 exhibited the far better Young's modulus than that of the cast products made from the conventional aluminum alloys, e.g., JIS1060 through JIS2040, A390, and the like, which falls in a lower range of from 70 to 90 GPa.

Evaluation No. 7

The heat resistance aluminum alloys of Example Nos. 8 through 15 were examined for the thermal expansion coefficient. Example Nos. 8 through 11 exhibited a thermal expansion coefficient of $16\times10^{-6}$/°C., and Example Nos. 12 through 15, which included Si in the lesser amount, exhibited a slightly higher thermal expansion coefficient of $17.5\times10^{-6}$/°C. Thus, Example Nos. 8 through 15 exhibited the less thermal expansion coefficient than that of the cast products made from the conventional aluminum alloys, e.g., JIS 1060 through JIS2040, A390 and the like, which falls in a range of from $19\times10^{-6}$ to $22\times10^{-6}$/°C., and they were thus superb in the thermal expansion characteristic as well.

As having been detailed so far, since Example Nos. 8 through 20 of the present heat resistant aluminum alloys included Ni, Si, and Fe and/or Cu in the predetermined amount, not only they were light-weight but also they were superior in the wear resistance and the tensile strengths at room temperature and at high temperatures. For instance, they exhibited the tensile strengths of 550 MPa or more and 450 MPa or more, respectively, at room temperature and at 150° C.

In particular, in addition to the aforementioned advantageous effects, Example Nos. 8 through 10, 12 through 18 and 20 including Zr and/or Ti in the predetermined amount were further improved in the toughness and the yield strength, and they were less likely to suffer from the strength deterioration even after they were left at the high temperatures for a long period of time. Additionally, when the sum of Ni, Zr and Ti fell in the range of from 8.0 to 18%, e.g., in Example Nos. 8 through 18 and 20, especially Example Nos. 8 thorough 11, the advantageous characteristics fluctuated less.

Third Preferred Embodiments

Third Preferred Embodiments of the present invention, e.g., Example Nos. 21 through 30, will be hereinafter described with reference to Tables 6 and 7 and FIG. 3 along with Comparative Example Nos. 25 through 30.

Example Nos. 21 through 30 and Comparative Example Nos. 25 through 30 were prepared in the same manner as set forth in the "First Preferred Embodiment" section, and they were subjected to the following 5 evaluations, e.g., Evaluation Nos. 8 through 12.

Evaluation No. 8

Example Nos. 21 through 30 and Comparative Example Nos. 25 through 30 were examined for the strength characteristics, e. g. , the tensile strength, the yield strength and the elongations, at room temperature, 150° C. and 300° C., and the results of the examinations are set forth in Table 6 together with the compositions.

As can be appreciated from Table 6, all of Example Nos. 21 through 30 exhibited a tensile strength of more than 550 MPa and more than 200 MPa, respectively, at room temperature and at 300° C., and they were thus superb in the room and high temperature strength.

TABLE 6

| | COMPOSITION (%) | R.T. T.S. | 150° C. T.S. | 150° C. Y.S. | 150° C. δ | 300° C. T.S. | 300° C. Y.S. | 300° C. δ |
|---|---|---|---|---|---|---|---|---|
| Ex. 21 | Al-20Ni-15Si-1Fe | 534 | 449 | | | 303 | 206 | 2.1 |
| Ex. 22 | Al-15Ni-20Si-3Cu | 569 | 484 | 472 | 0.3 | 250 | 164 | 4.0 |

TABLE 6-continued

| | COMPOSITION (%) | R.T. T.S. | 150° C. T.S. | 150° C. Y.S. | 150° C. δ | 300° C. T.S. | 300° C. Y.S. | 300° C. δ |
|---|---|---|---|---|---|---|---|---|
| Ex. 23 | Al-15Ni-15Si-3Cu | 554 | 486 | 486 | 0.2 | 294 | 191 | 3.2 |
| Ex. 23 | Al-15Ni-15Si-3Cu | 613 | | | | 274 | 177 | 3.6 |
| Ex. 24 | Al-10Ni-20Si-3Cu | 526 | | | | 243 | 156 | 6.2 |
| Ex. 25 | Al-12Ni-8Si-3Fe-3Cu | 681 | 556 | 499 | 1.4 | 282 | 192 | 6.8 |
| Ex. 25 | Al-12Ni-8Si-3Fe-3Cu | 650 | 533 | 483 | 0.6 | 265 | 185 | 5.8 |
| Ex. 26 | Al-11Ni-8Si-3Fe-1Zr-3Cu | 676 | 546 | 457 | 1.8 | 244 | 182 | 7.8 |
| Ex. 26 | Al-11Ni-8Si-3Fe-1Zr-3Cu | 665 | 515 | 468 | 0.8 | 240 | 177 | 6.8 |
| Ex. 27 | Al-10Ni-8Si-3Fe-2Ti-3Cu | 683 | 533 | 473 | 0.8 | 286 | 208 | 5.6 |
| Ex. 27 | Al-10Ni-8Si-3Fe-2Ti-3Cu | 535 | 528 | 468 | 0.8 | 278 | 208 | 5.4 |
| Ex. 28 | Al-12Ni-15Si-3Fe | 535 | 489 | | | 314 | 265 | 0.9 |
| Ex. 29 | Al-10Ni-12Si-7Fe | 585 | 514 | | | 295 | 226 | 1.0 |
| Ex. 30 | Al-10Ni-25Si-3Fe-1Cu | 514 | 415 | | | 290 | 233 | 0.9 |
| C. E. 25 | Al-15Ni-25Si | 457 | 415 | | | 288 | 196 | 1.6 |
| C. E. 26 | Al-15Ni-20Si | 460 | 418 | | | 288 | 188 | 2.0 |
| C. E. 27 | Al-10Ni-20Si | 468 | | | | 196 | 152 | 6.0 |
| C. E. 28 | Al-10Ni-15Si | 496 | | | | 177 | 148 | 9.6 |
| C. E. 29 | Al-10Ni-10Si | 469 | | | | 160 | 133 | 12.9 |
| C. E. 30 | Al-15Ni-15Si-3Cu-1Mg | 536 | 478 | | | 263 | 178 | 3.1 |
| C. E. 30 | Al-15Ni-15Si-3Cu-1Mg | 480 | 457 | | | 256 | 181 | 1.6 |

(Note)
R.T.: Room Temperature, T.S.: Tensile Strength (MPa),
Y.S.: Yield Strength, & δ: Elongation (%)

On the other hand, all of Comparative Example Nos. 25 through 29, which did not include either Cu or Fe, exhibited a tensile strength of less than 500 MPa at room temperature, and they were inferior to those of Examples 21 through 30 in the tensile strength at room temperature.

Further, when the strength characteristics of Example No. 23 free from Mg are compared with those of Comparative Example No. 30 including Mg, the tensile strengths of Example No. 23 at room temperature and at 300° C. were remarkably increased, respectively, by 133 MPa and 38 MPa with respect to those of Comparative Example No. 30 at the largest.

Furthermore, even when the contents of Ni, Fe and Cu were varied in Example Nos. 28, 29 and 30, they were superb in the yield strength at 300° C., and they were superior in the heat resistance.

Moreover, Example No 26 including Zr was especially good in the elongation at 300° C. Example No. 27 including Ti was particularly good in the yield strength at 300° C.

Evaluation No. 9

Example Nos. 21 through 30 were examined for the rigidity, e.g., the Young's modulus. The Young's modulus exhibited by Example Nos. 21 through 30 fell in a range of from 110 to 130 GPa. On the other hand, Young's modulus exhibited by the cast products made form the conventional aluminum alloys, e.g., JIS1060 through JIS2040, A390 falls in a lower range of from 70 to 90 GPa. Thus, Example Nos. 21 through 30 were remarkably good in the rigidity.

Evaluation No. 10

Example Nos. 21 through 30 were examined for the thermal expansion coefficient. Example Nos. 21 through 30 exhibited a thermal expansion coefficient of from $12.0\times10^{-6}$ to $15.0\times10^{31\ 6}$/°C. Thus, Example Nos. 21 through 30 exhibited a less thermal expansion coefficient than that of the cast products made from the conventional aluminum alloys, e.g. , JIS1060 through JIS2040, A390 and the like, which falls in a range of from $19\times10^{-6}$ to $22\times10^{-6}$/°C., and they were thus superb in the thermal expansion characteristic as well.

According to the results of Evaluations Nos. 8 through 10 described above, Example Nos. 21 through 30 prepared by powder metallurgy process or sintering process were not only light-weight but also excellent in the wear resistance, the rigidity, the thermal expansion characteristic and the tensile strength at room temperature. In particular, they exhibited a tensile strength of 200 MPa or more and a yield strength of 180 MPa or more at a high temperature of 300° C.

Especially, among Example Nos. 21 through 30, Example No. 26 including Zr in the predetermined amount exhibited a high elongation of 0.5% or more and 5.0% or more, respectively, at room temperature and at 300° C., in addition to the aforementioned excellent characteristics. Example No. 27 including Ti in the predetermined amount exhibited a high yield strength of 200 MPa or more at 300° C., in addition to the aforementioned excellent characteristics.

Evaluation No. 11

The following 3 heat resistant aluminum alloys were prepared in order evaluate the wear resistance: Example No. 31 having the composition identical with that of Example No. 23, and Example No. 32 and 33, which were made from Al—10Ni—8Si—3Fe—2Ti and Al—12Ni—8Si—3Fe—1Zr aluminum alloy powders, respectively.

Further, the following 3 comparative examples were prepared in order to compare the wear resistance with those of Example Nos. 31 through 33: Comparative Example No. 31 , i.e. , an aluminum alloy cast product made from A390 aluminum alloy by casting, Comparative Example No. 32, i.e. , an Al alloy-based MMC cast product made from JIS2024 aluminum alloy and including SiC whiskers dispersed therein in an amount of 20%, and Comparative Example No. 33, i.e., an aluminum alloy made from JIS2024 aluminum alloy powder and including SiC particles added thereto in an amount of 30%.

Example Nos. 31 through 33 and Comparative Example Nos. 31 through 33 were subjected to a wear test using an "OHKOSHI" type wear tester. The wear test was carried out under the following 2 conditions in order to examine the worn area (in $mm^2$) and the specific wear amount ($\times10^{-6}$ $mm^3$/kgf·mm). FIG. 3 illustrates the results of the wear test.

Condition "A": A speed of 0.31 m/s, a load of 6.3 kgf, and a travel of 100 m; and Condition "B": A speed of 0.91 m/s, a load of 12.6 kgf, and a travel of 100 m.

An Fe sintered alloy made from Fe—0.8C—5Mo—2.5Co alloy was used for a mating member in both of the conditions.

Figure 3:
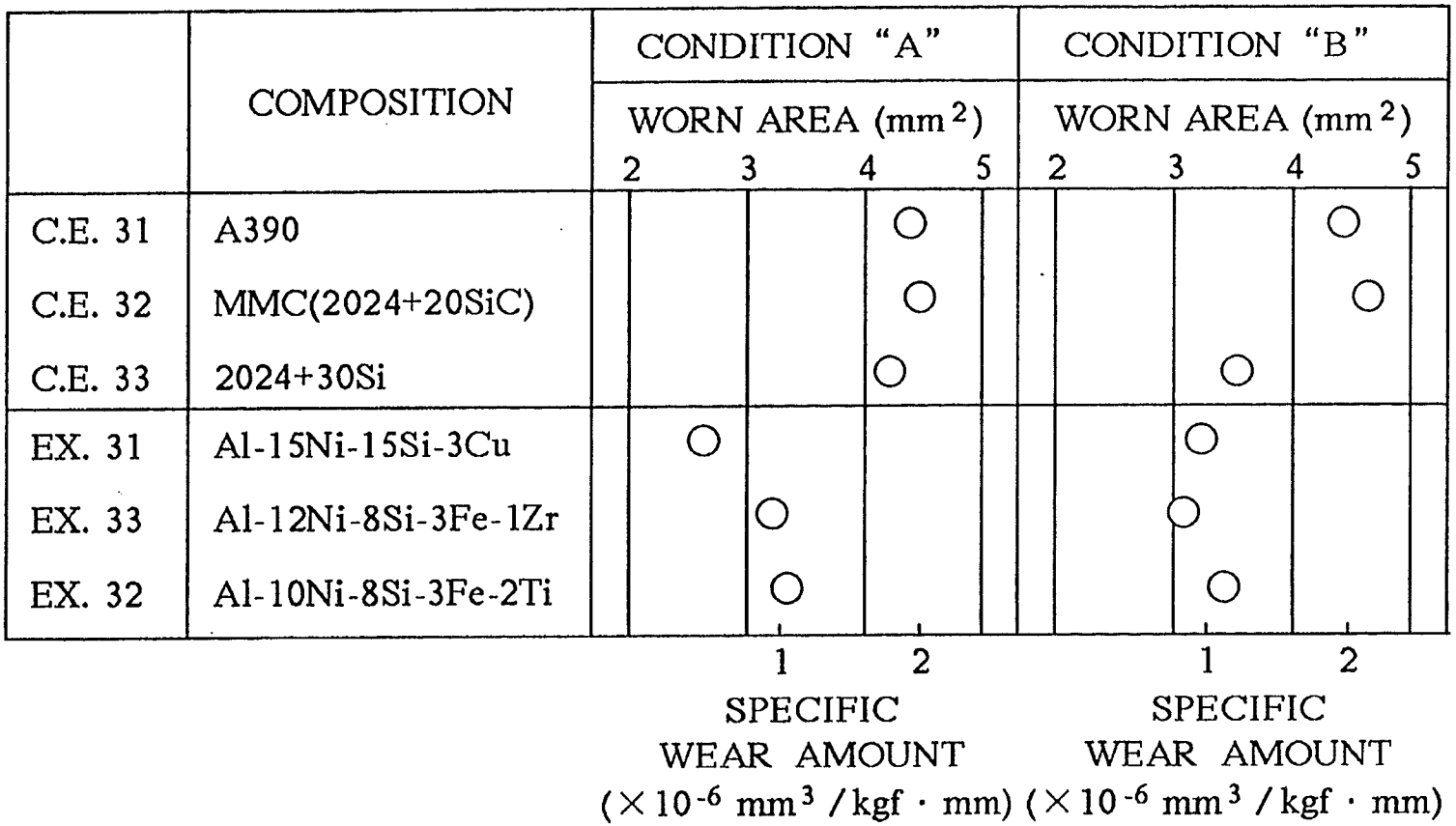
FIG. 3 is a diagram illustrating the results of a wear test for worn areas and specific wear amounts which were exhibited by preferred embodiments of present invention and comparative examples in Evaluation No. 11.

As illustrated in FIG. 3, all of Example Nos. 31 through 33 exhibited a less worn area and a less specific wear amount than Comparative Example Nos. 31 through 33 did, and they thus were superior in the wear resistance as well.

Evaluation No. 12

Example Nos. 34 and 35 were prepared as follows: The present heat resistant aluminum powders, which were pulverized by atomizing process in air and classified with a minus 100 mesh sieve, were subjected to Cold Isostatic Pressing (hereinafter simply referred to as "CIP") process, e.g., cold hydrostatic pressing, and the resulting green compacts were heated and extruded in air, respectively. The compositions of Example Nos. 34 and 35 are set forth in Table 7 below together with the oxygen contents.

Example Nos. 36 and 37 were prepared as follows: The present heat resistant aluminum powders, which were pulverized by nitrogen-atomizing process with nitrogen as an atomizing medium in air and classified with a minus 100 mesh sieve, were subjected to CIP process, e.g., cold hydrostatic pressing, and the resulting green compacts were heated and extruded in air, respectively. The compositions of Example Nos. 36 and 37 are set forth in Table 7 below together with the oxygen contents.

Comparative Example Nos. 34 and 35 were prepared as follows: The conventional heat resistant aluminum powders, which were pulverized by nitrogen-atomizing process in nitrogen atmosphere and classified with a minus 100 mesh sieve, were canned in a bottomed can which was made from pure aluminum, respectively. The cans were then vacuumed, degassed and sealed. After carrying out hot isostatic pressing (hereinafter simply referred to as "HIP") process, e.g., hot hydrostatic pressing, the cans were heated and extruded, respectively. The compositions of Comparative Example Nos. 34 and 35 are set forth in Table 7 below together with the oxygen contents.

TABLE 7

| No. | Production Process | Composition | Oxygen Content (%) |
|---|---|---|---|
| Ex. 34 | 1) Air-atomizing in air;<br>2) Minus 100 mesh sieve classifying;<br>3) CIP; and<br>4) Heated extrusion in air | Al-15Ni-15Si-3Cu | 0.26 |
| Ex. 35 | 1) Air-atomizing in air;<br>2) Minus 100 mesh sieve classifying;<br>3) CIP; and<br>4) Heated extrusion in air | Al-15Ni-20Si-3Cu | 0.33 |
| Ex. 36 | 1) $N_2$-atomizing in air;<br>2) Minus 100 mesh sieve classifying;<br>3) CIP; and<br>4) Heated extrusion in air | Al-15Ni-15Si-3Cu | 0.12 |
| Ex. 37 | 1) $N_2$-atomizing in air;<br>2) Minus 100 mesh sieve classifying;<br>3) CIP; and<br>4) Heated extrusion in air | Al-15Ni-20Si-3Cu | 0.08 |
| Comp. Ex. 34 | 1) $N_2$-atomizing in $N_2$;<br>2) Minus 100 mesh sieve classifying;<br>3) Vacuuming;<br>4) Degassing<br>5) Sealing in can;<br>6) HIP; and<br>7) Heated extrusion in can in air | Al-15Ni-15Si-3Cu | 0.04 |
| Comp. Ex. 35 | 1) $N_2$-atomizing in $N_2$;<br>2) Minus 100 mesh sieve classifying;<br>3) Vacuuming;<br>4) Degassing<br>5) Sealing in can;<br>6) HIP; and<br>7) Heated extrusion in can in air | Al-15Ni-20Si-3Cu | 0.03 |

Generally speaking, oxygen damages the strengths, the elongations, and the like of heat resistant aluminum alloys. However, Example Nos. 34 and 35 verified that the present heat resistant aluminum alloys exhibiting the wear resistance, the rigidity, the thermal expansion characteristic, the room temperature strength and the high temperature strength similar to those exhibited by Example Nos. 21 through 30 can be produced without carrying out the vacuuming, degassing and sealing operations as done in the preparation of Comparative Example Nos. 34 and 35. Thus, it is appreciated from Table 7 that the physical properties of the present heat resistant aluminum alloys are not adversely affected substantially by including O therein in an amount of 0.40% or less.

In particular, even when the oxygen content fell in a range of from 0.05 to 0.40%, the resulting heat resistant aluminum alloys exhibited the excellent characteristics similarly to Example Nos. 21 through 30. Accordingly, the production process of the present heat resistant aluminum alloys can be simplified, and the production cost can be reduced.

As having been described in detail so far, since Example Nos. 21 through 30 of the present heat resistant aluminum alloys included Ni, Si, Fe and Cu in the predetermined amount and they were free from Mg, not only they were light-weight, but also they were superb in the wear resistance, the room temperature strength and the high temperature strength. For instance, they exhibited a high tensile strength and a high yield strength of 200 MPa or more and 180 MPa or more, respectively, at 300° C.

Further, when the present heat resistant aluminum alloys, e.g., Example Nos. 26 and 27, included at least one of Zr and Ti in the predetermined amount, not only they had the aforementioned superb characteristics, but also they exhibited an exceptionally good toughness. For instance, they exhibited elongations of 0.4% or more and 2.5% or more, respectively, at room temperature and 300° C.

Furthermore, when the present heat resistant aluminum alloys, e.g., Example Nos. 34 and 35, included oxygen in the relatively large amount, they maintained the high strength at room temperature and the high temperature. Accordingly, the production process of the present heat resistant aluminum alloys can be simplified, and the production cost can be reduced.

Fourth Preferred Embodiments

Fourth Preferred Embodiments of the present invention, e.g., Example Nos. 38 through 40, will be hereinafter described with reference to Tables 8 and 9 along with Comparative Example Nos. 36 through 39. In Table 8, please not that the numbers before the elements specify the content of the elements in % by weight with respect to the matrix taken as 100% by weight, and the numbers before the additives, e.g., nitride particles, boride particles, etc., specify the content of the additives in % by weight with respect to the sum of the matrix and the additives, i.e., the whole Al alloy-based MMCs, taken as 100% by weight.

Example Nos. 38 through 40 were prepared in the same manner as set forth in the "First Preferred Embodiment" section except that either nitride or boride particles having a particle diameter of from 1 to 20 micrometers were mixed with the resulting powders after the minus 100 mesh sieving operation. Comparative Example Nos. 36 and 37, i.e., the simple present heat resistant aluminum alloys, were prepared in the same manner as set forth in the "First Preferred Embodiment" section. Comparative Example Nos. 38 and 39, i.e., the conventional Al alloy-based MMCs, were prepared in the same manner as set forth in the "First Preferred Embodiment" section except that SiC fine particles having an average particle diameter of 2.6 micrometers were mixed with the resulting powders after the minus 100 mesh sieving operation. The matrix compositions of Comparative Example Nos. 38 and 39 were those of JIS2024 and JIS 6061 aluminum alloys, respectively.

Example Nos. 38 through 40 and Comparative Example Nos. 36 through 39 were subjected to the following 3 evaluations, e.g., Evaluation Nos. 13 through 15.

TABLE 8

| | MATRIX COMPOSITION (%) | N.P. | B.P. | Others |
|---|---|---|---|---|
| Ex. 38 | Al-10Ni-0.5Si-3Fe-3Cu-1Zr-1Ti | 3AlN | — | — |
| Ex. 39 | Al-10Ni-0.5Si-3Fe-3Cu-1Zr-1Ti | — | $3TiB_2$ | — |
| Ex. 40 | Al-10Ni-8Si-3Fe-3Cu-1Zr-1Ti | 3AlN | — | — |
| C. E. 36 | Al-10Ni-0.5Si-3Fe-3Cu-1Zr-1Ti | — | — | — |
| C. E. 37 | Al-10Ni-8Si-3Fe-3Cu-1Zr-1Ti | — | — | — |
| C. E. 38 | Al-4.5Cu-1.6Mg-0.5Mn | — | — | 20SiC |
| C. E. 39 | Al-1.0Mg-0.6Si-0.3Cu | — | — | 20SiC |

(Note)
N.P.: Nitride Particles, & B.P.: Boride Particles

Evaluation No. 13

Example Nos. 38 through 40 and Comparative Example Nos. 36 through 39 were examined for the tensile strengths at room temperature and at 150° C., and they are examined for the yield strength and the elongation at 150° C. as well, and the results of the examinations are set forth in Table 9.

As can be appreciated from Table 9, all of Example Nos. 38 through 40 exhibited tensile strengths of more than 600 MPa and more than 450 MPa, respectively, at room temperature and at 150° C. as Comparative Example Nos. 36 and 37 which included the matrix free from the nitride and boride particles did, and they were thus superb in the room and high temperature strength. Hence, in view of the strength characteristics, the advantageous effect of the simple present heat resistant aluminum alloys were not adversely affected by including the nitride or boride particles in the matrices.

On the other hand, Comparative Example Nos. 38 and 39, whose matrix did not include either Cu or Fe, exhibited a low tensile strength of around 300 MPa.

TABLE 9

| | R.T. | 150° C. | | | Specific |
|---|---|---|---|---|---|
| | T.S. | T.S. | Y.S. | δ | Wear Amount |
| Ex. 38 | 616 | 473 | 422 | 2.0 | $7.9 \times 10^{-8}$ |
| Ex. 39 | 608 | 467 | 420 | 2.1 | $6.5 \times 10^{-8}$ |
| Ex. 40 | 610 | 488 | 441 | 0.8 | $4.1 \times 10^{-8}$ |
| C. E. 36 | 668 | 496 | 411 | 5.4 | $7.3 \times 10^{-7}$ |
| C. E. 37 | 614 | 510 | 446 | 1.3 | $5.8 \times 10^{-7}$ |
| C. E. 38 | 450 | 320 | — | — | $1.9 \times 10^{-7}$ |
| C. E. 39 | 526 | 286 | — | — | $2.0 \times 10^{-7}$ |

(Note)
R.T.: Room Temperature, T.S.: Tensile strength (MPa)
Y.S.: Yield strength (MPa), δ: Elongation (%), & Unit of Specific Wear Amount: $mm^3/kgf \cdot mm$

Evaluation No. 14

Example Nos. 38 through 40 and Comparative Example Nos. 36 through 39 were subjected to a wear test in order to examine the wear amount. The wear amount was examined by an "LFW" testing machine. Each of Example Nos. 38 through 40 and Comparative Example Nos. 36 through 39 was formed in a plate-shaped test piece having a width of 10 mm and a length of 15.7 mm and a thickness of 6.35 mm. During the wear test, the test pieces were immersed into an oil, it was pressed against a ring-shaped mating member made of SUJ2 (as per JIS) at load of 150 N and at a sliding speed of 18 m/minute. The wear test was carried out for 15 minutes. The results of this wear test are also set forth in Table 9.

Comparing the wear resistances in terms of the specific wear amount, Example Nos. 38 through 40 exhibited a specific wear amount which was reduced by one digit with respect to those of Comparative Example Nos. 36 and 37. Thus, it is apparent that the presence of the nitride or boride particles in the matrices reduced the wear amounts.

Especially, in Example Nos. 38 and 40 in which the nitride particles were added, the aluminum elements did not migrate to the mating member made of SUJ2, the friction coefficients were low, and thereby they exhibited a good sliding characteristic. Generally speaking, in the friction between Al member and Fe member, the aluminum elements of the Al member are likely to migrate to the Fe member, and thereby the wear resistance is degraded.

In Example No. 39 in which the boride particles were added, the boron elements of the boride particles were oxidized to $B_2O_3$ (mp. 450° C.) in part during the friction, $B_2O_3$ was melted to produce the liquid phase which resulted in the fluid lubrication. Thus, it is believed that Example No. 39 was improved in the wear resistance.

On the other hand, Comparative Example Nos. 38 and 39, whose matrix did not include Ni and Fe, exhibited a lower strength. Although the SiC fine particles were included therein, they did not contribute to the wear resistance improvement.

Evaluation No. 15

Figure 4:
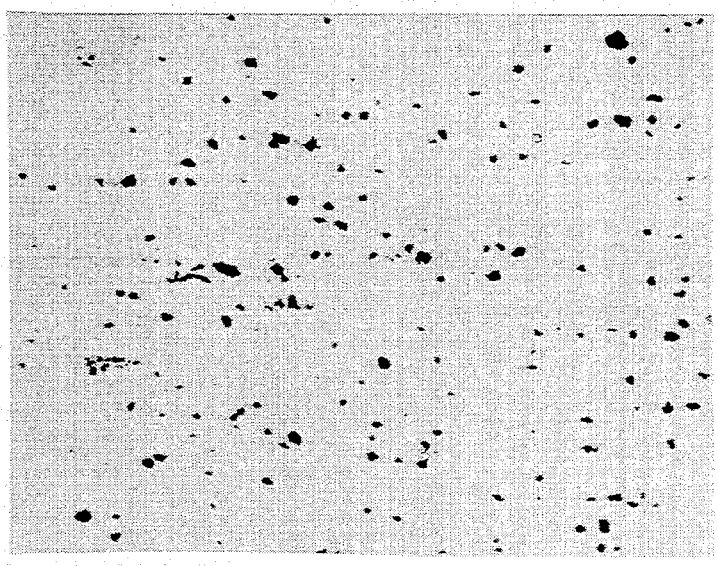
FIG. 4 is a photomicrograph of the metallographic structure of Example No. 38 (magnification×100)
Figure 5:
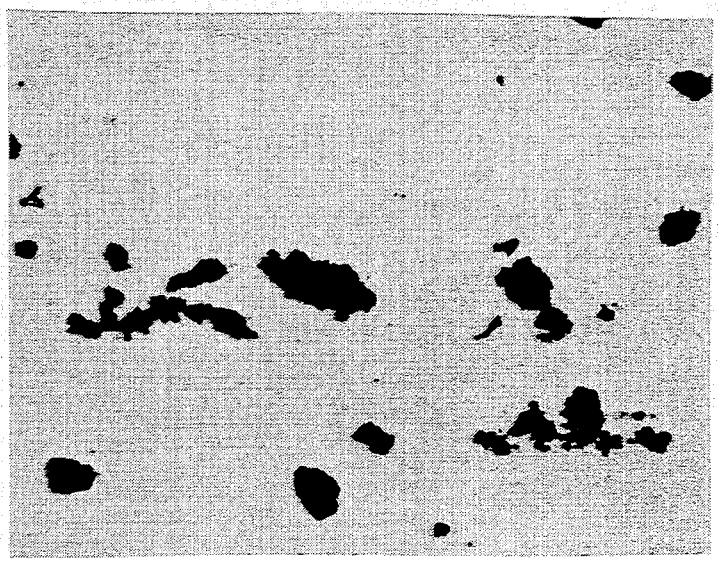
FIG. 5 is a photomicrograph which enlarges FIG. 4 (magnification×400)

FIG. 4 is a photomicrograph of the metallographic structure of Example No. 38 (magnification × 100). As can be seen from FIG. 4, the AlN additives were finely dispersed in the matrix. FIG. 5 is a photomicrograph which enlarges FIG. 4 by a magnification of 400. As can be seen from FIG. 5, the boundary surfaces of the AlN additives were well adhered to the matrix, and there were no porosities at all in the boundaries.

According to Evaluation Nos. 13 through 15, not only Example Nos. 38 through 40 of the present heat and wear resistant Al alloy-based MMCs were light-weight, but also they were superb in the wear resistance, the rigidity and the room temperature strength.

As having been detailed so far, since Example Nos. 38 through 40 of the present heat and wear resistant Al alloy-based MMCs included Ni, Si, Fe and Cu in the matrix in the predetermined amount, and since they included the nitride or boride particles dispersed in the matrix, not only they were light-weight and wear resistant, but also they exhibited the advantageous strength characteristics similar to those exhibited by the simple present heat resistant aluminum alloys, e.g., Example Nos. 1 through 37.

Further, when the present heat and wear resistant Al alloy-based MMCs, e. g., Example Nos. 38 through 40, included Zr and Ti in the predetermined amount, not only they were improved in the toughness and the yield strength, but also they were less degraded in the strengths even after they were left at high temperatures for a long period of time.

Furthermore, when the sum of Ni, Zr and Ti fell in the range of from 8.0 to 18%, the advantageous characteristics were were less likely to fluctuate.

Moreover, since the matrix of Example Nos. 38 through 40 was superior in the high temperature strength and the elongation, the resulting present heat and wear resistant Al alloy-based MMCs were also improved in the forgeability and the wear resistance.

Fifth Preferred Embodiments

Fifth Preferred Embodiments of the present invention, e.g., Example Nos. 41 through 44, will be hereinafter described with reference to Tables 10 and 11 along with Comparative Example Nos. 40 through 43. In Table 10, please not that the numbers before the elements specify the content of the elements in % by weight with respect to the matrix taken as 100% by weight, and the numbers before the additives, e.g., nitride particles, boride particles, etc., specify the content of the additives in % by weight with respect to the sum of the matrix and the additives, i.e., the whole Al alloy-based MMCs, taken as 100% by weight.

TABLE 10

| | Matrix Composition (%) | N.P. | B.P. | Others |
|---|---|---|---|---|
| Ex. 41 | Al-11Ni-8Si-1Zr-3Cu-3Fe | 3AlN | — | — |
| Ex. 42 | Al-14Ni-15Si-3Cu-1Ti | — | $3TiB_2$ | — |
| Ex. 43 | Al-11Ni-8Si-3Fe-1Zr-3Cu | 3TiN | — | — |
| Ex. 44 | Al-14Ni-15Si-3Cu-1Ti | — | $3MgB_2$ | — |
| C. E. 40 | Al-11Ni-8Si-1Zr-3Cu-3Fe | — | — | — |
| C. E. 41 | Al-14Ni-15Si-3Cu-1Ti | — | — | — |
| C. E. 42 | Al-4.5Cu-1.6Mg-0.5Mn | — | — | 20SiC |
| C. E. 43 | Al-1.0Mg-0.6Si-0.3Cu | — | — | 20SiC |

(Note)
N.P.: Nitride Particles, & B.P.: Boride Particles

Example Nos. 41 through 44 were prepared in the same manner as those of Example Nos. 38 through 40 of the Fourth Preferred Embodiment. Comparative Example Nos. 40 and 41, i.e., the simple present heat resistant aluminum alloys, were prepared in the same manner as set forth in the "First Preferred Embodiment" section. Comparative Example Nos. 42 and 43 were identical with Comparative Example Nos. 38 and 39 set forth in the "Fourth Preferred Embodiment" section.

Example Nos. 41 through 44 and Comparative Example Nos. 40 through 43 were subjected to the following 3 evaluations, e.g., Evaluation Nos. 16 through 18.

Evaluation No. 16

Example Nos. 41 through 44 and Comparative Example Nos. 40 through 43 were examined fox the tensile strengths at room temperature, at 150° C. and at 300° C., and they are examined for the yield strengths and the elongations at 150° C. and at 300° C. as well, and the results of the examinations are set forth in Table 11.

TABLE 11

| | R.T. | 150° C. | | | 300° C. | | | Specific |
|---|---|---|---|---|---|---|---|---|
| | T.S. | T.S. | Y.S. | δ | T.S. | Y.S. | δ | Wear Amount |
| Ex. 41 | 625 | 505 | 416 | 0.8 | 215 | 153 | 6.3 | $2.5 \times 10^{-8}$ |
| Ex. 42 | 502 | 416 | 403 | 0.3 | 206 | 165 | 2.0 | $3.6 \times 10^{-8}$ |
| Ex. 43 | 605 | 523 | 445 | 1.5 | 237 | 168 | 4.8 | $1.3 \times 10^{-7}$ |
| Ex. 44 | 515 | 438 | 400 | 0.3 | 205 | 172 | 1.8 | $2.1 \times 10^{-8}$ |
| C. E. 40 | 676 | 546 | 457 | 1.8 | 244 | 182 | 7.8 | $5.9 \times 10^{-7}$ |
| C. E. 41 | 548 | 486 | 473 | 0.3 | 237 | 171 | 2.3 | $7.5 \times 10^{-7}$ |
| C. E. 42 | 450 | 320 | — | ~0 | 105 | — | ~0 | $1.9 \times 10^{-7}$ |
| C. E. 43 | 520 | 286 | — | ~0 | 88 | — | ~0 | $2.0 \times 10^{-7}$ |

(Note)
R.T.: Room Temperature, T.S.: Tensile Strength (MPa), Y.S.: Yield Strength (MPa), δ: Elongation (%), & Unit of Specific Wear Amount: $mm^3/kgf \cdot mm$ As can be appreciated from Table 11, Example Nos. 41 through 44 as well as Comparative Example Nos. 40 and 41 exhibited tensile strengths of more than 500 MPa and more than 200 MPa, respectively, at room temperature and at 300° C., and they were thus superb in the room and high temperature strength. Here, the matrix of Comparative Example No. 40 was identical with those of Example Nos. 41 and 43, the matrix of Comparative Example No. 41 was identical with those of Example Nos. 42 and 44. Hence, the advantageous effect of the simple present heat resistant aluminum alloys were not adversely affected by including the nitride or boride particles in the matrices.

On the other hand, Comparative Example Nos. 42 and 43 exhibited a tensile strength of around 500 MPa at room temperature, but they exhibited a degraded tensile strength of around 100 MPa at 300° C. This resulted from the fact that the matrices, i.e., the conventional aluminum alloys, of Comparative Example Nos. 42 and 43 inherently exhibited a low strength at high temperatures. Further, since the SiC fine particles did not conform to the matrices, the cracks occurred in the grain boundaries and they were likely to propagate. As a result, Comparative Example Nos. 42 and 43 were hardly elongated, and thereby it was impossible to evaluate their yield strengths.

Evaluation No. 17

Example Nos. 41 through 44 and Comparative Example Nos. 40 through 43 were also subjected to the wear resistance test in order to examine the wear amount as set forth in Evaluation No. 14 of the "Fourth Preferred Embodiment" section, and the results of this wear test are also set forth in Table 11.

As can be appreciated from Table 11, all of Example Nos. 41 through 44 exhibited a less specific wear amount than Comparative Example Nos. 40 and 41 did, and they were thus superb in the wear resistance as well. Comparative Example Nos. 42 and 43 were remarkably good in the wear resistance, but they exhibited a sharply deteriorated tensile strength at 300° C.

Especially, in Example Nos. 41 and 43 in which the nitride particles were added, the aluminum elements were less likely to migrate to the SUJ2 mating member during the wear test using the "LFW⇄ tester, and thereby they exhibited a good sliding characteristic. In Example Nos. 42 and 44 in which the boride particles were added, the boron elements of the boride particles were oxidized to $B_2O_3$ (mp. 450° C.) in part during the friction, $B_2O_3$ was melted to produce the liquid phase which resulted in the fluid lubrication. Thus, it is believed that Example Nos. 42 and 44 were remarkably improved in the wear resistance.

Evaluation No. 18

Figure 6:
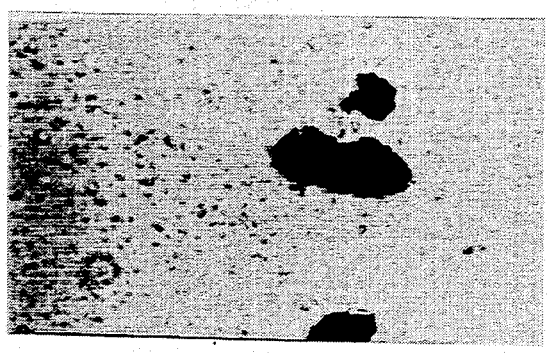
FIG. 6 is a photomicrograph of the metallographic structure of Example No. 41 (magnification×400)
Figure 7:
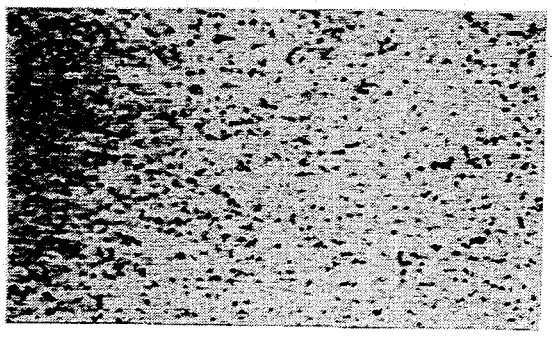
FIG. 7 is a photomicrograph of the metallographic structure of Comparative Example No. 40 (magnification×400)

FIG. 6 is a photomicrograph of the metallographic structure of Example No. 41 (magnification×800). As can be seen from FIG. 6, the AlN additives were dispersed in the matrix, and they were in close contact with the boundaries of the matrix without forming the porosities in the boundaries. FIG. 7 is a photomicrograph of the metallographic structure of Comparative Example No. 40 (magnification×800), and it shows that the metallographic structure was uniform.

According to Evaluation Nos. 16 through 18, not only Example Nos. 41 through 44 of the present heat and wear resistant Al alloy-based MMCs were lightweight, but also they were superb in the wear resistance, the rigidity, the thermal expansion characteristic, and the room temperature strength. In particular, they exhibited a tensile strength of 200 MPa or more.

As having been detailed so far, since Example Nos. 41 through 44 of the present heat and wear resistant Al alloy-based MMCs included Ni, Si, Fe and Cu in the matrix in the predetermined amount, and since they included the nitride or boride particles dispersed in the matrix, not only they were light-weight and wear resistant, but also they exhibited the advantageous strength characteristics similar to those exhibited by the simple present heat resistant aluminum alloys, e.g., Example Nos. 1 through 37.

Sixth Preferred Embodiments

Sixth Preferred Embodiments of the present invention, e.g., Example Nos. 45through 49, will be hereinafter described with reference to Table 12 and FIG. 2 along with Comparative Example Nos. 44 through 48. In Table 12, please not that the numbers before the elements specify the content of the elements in % by weight with respect to the matrix taken as 100% by weight, and the numbers before the additives, e.g., nitride particles, boride particles, etc., specify the content of the additives in % by weight with respect to the sum of the matrix and the additives, i.e., the whole Al alloy-based MMCs, taken as 100% by weight.

Example Nos. 45 through 49 and Comparative Example Nos. 44 through 48 were prepared in the same manner as those of Example Nos. 38 through 40 of the Fourth Preferred Embodiment. In the preparation of Example Nos. 45 through 49 and Comparative Example Nos. 44 through 48, the AlN particles ($D_{50}$=7.3 micrometers) made by TOYO ALUMINIUM Co., Ltd. were used, the $TiB_2$ particles ($D_{50}$=2.3 micrometers) made by IDEMITSU SEKIYU KAGAKU Co., Ltd. were used, and the SiC whiskers (from 0.2 to 1.0 micrometer in diameter and from 10 to 30 micrometers in length) made by TOKAI CARBON Co., Ltd. were used.

Example Nos. 45 through 49 and Comparative Example Nos. 44 through 48 were subjected to the following 4 evaluations, e.g., Evaluation Nos. 19 through 22.

Evaluation No. 19

Example Nos. 45 through 49 and Comparative Example Nos. 44 through 48 were examined for the tensile strengths, the yield strengths and the elongations at room temperature, at 150° C. and at 300° C., and the results of the examinations are set forth in Table 12.

As can be appreciated from Table 12, all of Example Nos. 45 through 49 exhibited a tensile strength of more than 500 MPa at room temperature, and they were thus superb in the room temperature strength. Further, all of Example Nos. 45 through 49 exhibited a tensile strength of more than 200 MPa at 300° C., and they were thus splendid in the high temperature strength. Furthermore, in spite of these excellent strength characteristics, Example Nos. 45 through 49 exhibited elongations of from 0.2 to 0.5% and 5% or more, respectively, at room temperature and at 300° C. Thus, they had a fuller toughness which had not been expected from the sintered conventional aluminum alloys, and they were thus superior in the forgeability.

TABLE 12

| | COMPOSITION (%) | R.T. | | | 150° C. | | | 300° C. | | | C. U. F. at | Specific |
|---|---|---|---|---|---|---|---|---|---|---|---|---|
| | | T.S. | Y.S. | δ | T.S. | Y.S. | δ | T.S. | Y.S. | δ | 450° C. (%) | Wear Amount |
| Ex. 45 | Al-11Ni-8Si-3Fe-1Zr-3Cu + 3AlN | 633 | 580 | 0.5 | 503 | 452 | 1.1 | 247 | 181 | 5.9 | 60.8 | 4 |
| Ex. 46 | Al-13Ni-8Si-2Ti-3Cu + 3AlN | 555 | 546 | 0.2 | 487 | 468 | 1.0 | 239 | 193 | 6.8 | 67.5 | 3 |
| Ex. 47 | Al-10Ni-8Si-3Fe-2Ti-3Cu + 3AlN | 601 | 557 | 0.2 | 494 | 435 | 0.7 | 269 | 210 | 6.1 | 70.9 | 6 |
| Ex. 48 | Al-10Ni-8Si-3Fe-2Ti-3Cu + 3$TiB_2$ | 625 | 550 | 0.3 | 505 | 448 | 0.6 | 275 | 205 | 5.1 | 70.0 | 4 |
| Ex. 49 | Al-12Ni-12Si-2Ti-2Zr + 3AlN | 518 | 465 | 0.4 | 458 | 399 | 0.9 | 248 | 186 | 5.3 | 57.4 | 3 |
| C. E. 44 | Al-15Ni-20Si + 3AlN | 480 | — | — | 438 | — | — | 288 | 204 | 2.0 | 40.5 | 2 |
| C. E. 45 | Al-15Ni-20Si +3$TiB_2$ | 493 | — | — | 445 | — | — | 274 | 195 | 2.4 | 45.0 | 3 |

TABLE 12-continued

| | COMPOSITION (%) | R.T. T.S. | R.T. Y.S. | R.T. δ | 150° C. T.S. | 150° C. Y.S. | 150° C. δ | 300° C. T.S. | 300° C. Y.S. | 300° C. δ | C. U. F. at 450° C. (%) | Specific Wear Amount |
|---|---|---|---|---|---|---|---|---|---|---|---|---|
| C. E. 46 | Al-10Ni-25Si-3Cu + 3AlN | 486 | — | — | 430 | — | — | 288 | 283 | 0.2 | — | — |
| C. E. 47 | Al-0.6Si-0.3Cu-1.1Mg + 15SiC | 385 | 265 | 2.5 | 330 | 305 | 3.8 | 153 | 129 | 8.0 | 75.2 | — |
| C. E. 48 | Al-10Ni-8Si-3Fe-2Ti-3Cu + 15AlN | 568 | — | — | 479 | — | — | 230 | 205 | 0.9 | — | 0.5 |

(Note)
R.T.: Room Temperature, T.S.: Tensile Strength (MPa), Y.S.: Yield Strength (Mpa), δ: Elongation (%), C. U. F.: Critical Upsetting factors, & Unit of Specific Wear amount: $mm^3/kgf \cdot mm$ On the other hand, Comparative Example Nos. 44 through 46 and 48 had a low elongation at 300° C., and they were thus inferior in the forgeability.

Figure 8:
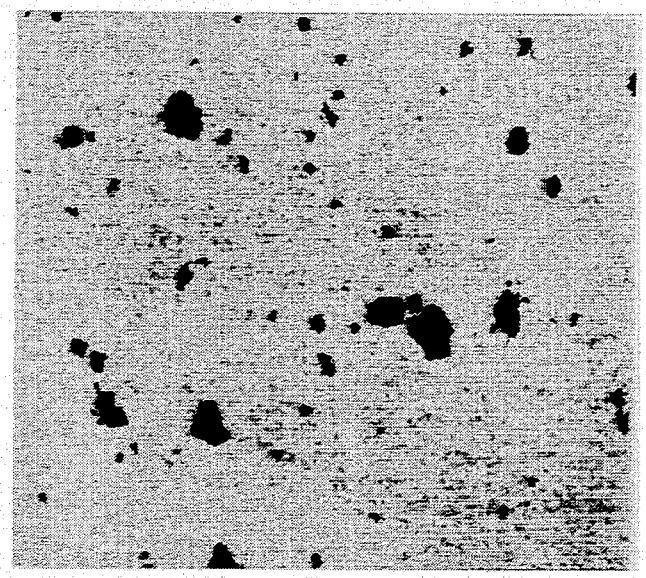
FIG. 8 is a photomicrograph of the metallographic structure of Example No. 47 (magnification×400)
Figure 9:
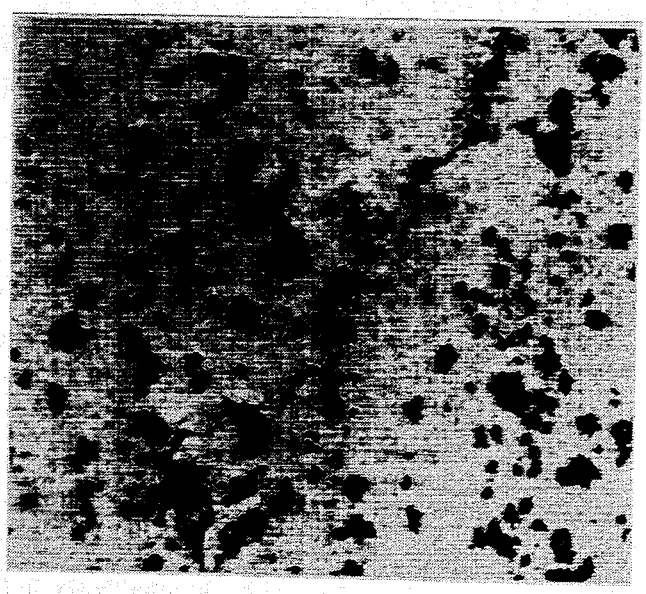
FIG. 9 is a photomicrograph of the metallographic structure of Comparative Example No. 48 (magnification×400)

The metallographic structures of Example No. 47 and Comparative Example No. 48 were photographed with a microscope. FIG. 8 is a photomicrograph of the metallographic structure of Example No. 47 (magnification×400 ), and FIG. 9 is a photomicrograph of the metallographic structure of Comparative Example No. 48 (magnification×400 ). As can be seen from FIGS. 8 and 9, even when the compositions of the matrices were identical in Example No. 47 and Comparative Example No. 48, the cracks were less likely to develop in Example No. 47 which included the AlN particles in an appropriate amount of 3%, but the cracks were likely to occur along the AlN particles in Comparative Example No. 48 which included the AlN particles in a large amount of 15%. Thus, when the sum of nitride and/or boride particles dispersed in the matrix exceeds 10%, the resulting MMCs were found to exhibit a sharply deteriorated tensile strength, elongation and machinability.

Evaluation No. 20

Example Nos. 45 through 49 and Comparative Example Nos. 44 through 48 were machined to the test piece "T/P" illustrated in FIG. 2 and described in Evaluation No. 2 of the "First Preferred Section" in a quantity of from 5 to 8, respectively. The test pieces "T/P" were examined for the critical upsetting factor as set forth in Evaluation No. 2 of the "First Preferred Embodiment" section, and the results of the examination are also set forth in Table12.

As can be seen appreciated from Table 12, Example Nos. 45 through 449 substantially exhibited a critical upsetting factor of more than 70% approximately. Thus, in addition to the splendid strength characteristics, they effected the superior forgeability.

On the other hand, Comparative Example Nos. 44 and 45 exhibited a low critical upsetting factor because they included Si in a large amount. Thus, they were inferior in the forgeability, and Comparative Example No. 46 is believed to be inferior as well. Namely, the conventional wear resistant Al alloy-based MMCs are associated with the degraded forgeability. Further, since Comparative Example No. 47 included the matrix equivalent to JIS6061 aluminum alloy, and it exhibited a high critical upsetting factor, and it was superior in the forgeability. However, it exhibited remarkably low strengths. Hence, the greater Comparative Example Nos. 44 through 48 exhibited a high temperature strength, the lower they exhibited an elongation. In other words, the lower they exhibited a high temperature strength, the better they were in the forgeability.

Evaluation No. 21

Example Nos. 45 through 49 and Comparative Example Nos. 44 through 48 were examined for the wear amount by the wear test as set forth in Evaluation No. 14 of the "Fourth Preferred Embodiment" section, and the results of the wear test are also set forth in Table 12.

As can be appreciated from Table 12, all of Example Nos. 45 through 49 exhibited a relatively small specific wear amount, and they were thus superb in the wear resistance. This resulted from the fact that the AlN particles and the $TiB_2$ particles were dispersed in the matrix, i.e., the present heat resistant aluminum alloy, so that the aluminum elements were not adhered to the mating member. Accordingly, in Example Nos. 44 through 48, the adhesion wear associated with aluminum was less likely to occur.

On the other hand, Comparative Example Nos. 44 and 45 also exhibited a relatively less small specific wear amount, and they were also superb in the wear resistance. However, according to Evaluation No. 20, they suffered from the bad forgeability.

Evaluation No. 22

Figure 10:
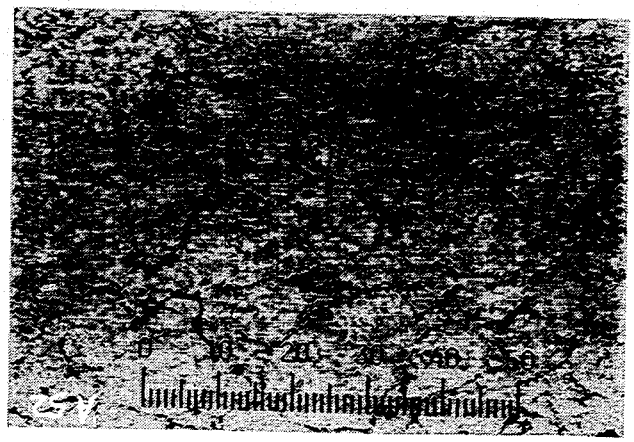
FIG. 10 is a photomicrograph of the metallographic structure of Al-based MMC prepared in Evaluation No. 22 (magnification×400).

An Al-based MMC was prepared as follows: $Al_2O_3$ particles having an average particle diameter of 0.5 micrometers were added to an aluminum powder having an average particle diameter of 33 micrometers in an amount of 3%, and the mixture was made into an Al-based MMC by powder metallurgy process. The metallographic structure of the resulting Al-based MMC was photographed with a microscope. FIG. 10 is a photomicrograph of the metallographic structure of the Al-based MMC (magnification×400).

As can be seen from FIG. 10, the $Al_2O_3$ particles were segregated in the boundaries between the aluminum grains when the additives dispersed in the aluminum matrix had a particle diameter of less than 1 micrometer. Thus, the additive having an average particle diameter of less than 1 micrometer might affect the tensile strength and the elongation so that the resulting MMCs could not be adapted to certain applications.

As having been detailed so far, since Example Nos. 45 through 49 of the present heat and wear resistant Al alloy-based MMCs included Ni, Si, and Zr and/or Ti in the matrix in the predetermined amount, and since they included the nitride or boride particles dispersed in the matrix, not only they exhibited the superb toughness and the improved forgeability, but also they exhibited the superior wear resistance and strength at the high temperatures.

In particular, Example Nos. 45 through 48 including Fe and/or Cu in the predetermined amount resulted in the present heat and wear resistant Al alloy-based MMCs which exhibited further enhanced room and high temperature strengths.

Having now fully described the present invention, it will be apparent to one of ordinary skill in the art that many changes and modifications can be made thereto without departing from the spirit or scope of the present invention as set forth herein including the appended claims.

What is claimed is:

1. A heat and wear resistant aluminum alloy-based composite comprising:

a matrix; and at least one of nitride particles and boride particles dispersed, with respect to the whole composite including the matrix taken as 100% by weight, in the matrix in an amount of from 0.5 to 10% by weight;

the matrix consisting, with respect to the matrix taken as 100% by weight, essentially of:

Ni in an amount of from 10 to 20% by weight;

Si in an amount of from 2.0 to 25% by weight;

at least one of Fe in an amount of from 0.6 to 8.0% by weight and Cu in an amount of from 0.6 to 5.0% by weight; and the balance of Al; and the aluminum alloy-based composite being formed by a powder metallurgy process.

2. The heat and wear resistant aluminum alloy-based composite according to claim 1 including, with respect to said matrix taken as 100% by weight, Si in an amount of from 0.2 to 15% by weight, and the sum of Fe and Cu falling in a range of from 2.0 to 10% by weight.

3. The heat and wear resistant aluminum alloy-based composite according to claim 1 including, with respect to said matrix taken as 100% by weight, Si in an amount of from 0.2 to 8.0% by weight, and the sum of Fe and Cu falling in a range of from 2.0 to 10% by weight.

4. The heat and wear resistant aluminum alloy-based composite according to claim 2 or 3 further including, with respect to said matrix taken as 100% by weight, at least one of Zr in an amount of from 0.3 to 3.0% by weight and Ti in an amount of from 1.0 to 3.0% by weight.

5. The heat and wear resistant aluminum alloy-based composite according to claim 4 wherein the sum of Ni, Ti and Zr is an amount of up to 18% by weight with respect to said matrix taken as 100% by weight.

6. A heat and wear resistant aluminum alloy-based composite comprising:

a matrix; and at least one of nitride particles and boride particles dispersed, with respect to the whole composite including the matrix taken as 100% by weight, in the matrix in an amount of from 0.5 to 10% by weight;

the matrix consisting, with respect to the matrix taken as 100% by weight, essentially of:

Ni in an amount of from 10 to 20% by weight;

Si in an amount of from 8.0 to 25% by weight;

at least one of Fe in an amount of from 0.6 to 8.0% by weight and Cu in an amount of from 0.6 to 5.0% by weight; and the balance of Al;

being substantially free form Mg; and the sum of Fe and Cu falling in a range of 10% by weight or less; and the aluminum alloy-based composite formed by powder metallurgy process.

7. The heat and wear resistant aluminum alloy-based composite according to claim 6 further including, with respect to said matrix taken as 100% by weight, Zr in an amount of from 0.3 to 2.0% by weight.

8. The heat and wear resistant aluminum alloy-based composite according to claim 6 further including, with respect to said matrix taken as 100% by weight, Ti in an amount of from 1.0 to 4.0% by weight.

9. A heat and wear resistant aluminum alloy-based composite, comprising:

a matrix; and at least one of nitride particles and boride particles dispersed, with respect to the whole composite including the matrix taken as 100% by weight, in the matrix in an amount of from 0.5 to 10% by weight;

the matrix consisting, with respect to the matrix taken as 100% by weight, essentially of:

Ni in an amount of from 10 to 20% by weight;

Si in an amount of from 6.0 to 15% by weight;

at least one of Zr in an amount of from 0.3 to 3.0% by weight and Ti in an amount of from 0.3 to 3.0% by weight; and the balance of Al;

the aluminum alloy-based composite being formed by a powder metallurgy process.

10. The heat and wear resistant aluminum alloy-based composite according to claim 9 further including, with respect to said matrix taken as 100% by weight, at least one of Fe in an amount of from 0.6 to 5.0% by weight and Cu in an amount of from 0.6 to 5.0% by weight.

11. The heat and wear resistant aluminum alloy-based composite material according to claim 1, 6 or 9, wherein said nitride particles and said boride particles have an average particle diameter of from 0.2 to 20 micrometers.

* * * * *

UNITED STATES PATENT AND TRADEMARK OFFICE

CERTIFICATE OF CORRECTION

PATENT NO. 5,374,295

DATED December 20, 1995

INVENTOR(S) Hirohisa Miura, Kunihiko Imahashi, Yasuhiro Yamada, Hirohumi Michioka, Jun Kusui and Akiei Tanaka It is certified that error appears in the above-indentified patent and that said Letters Patent is hereby corrected as shown below:

Claim 6, column 30, line 9, change "form" to --from--.

Signed and Sealed this

Eighth Day of August, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,374,295

DATED : December 20, 1994

INVENTOR(S) : Hirohisa Miura et al.

It is certified that error appears in the above-indentified patent and that said Letters Patent is hereby corrected as shown below:

Claim 1, column 29, line 14, change "2.0" to --0.2--.

Signed and Sealed this

Ninth Day of July, 1996

Bruce Lehman

*Attest:*

BRUCE LEHMAN

*Attesting Officer*

*Commissioner of Patents and Trademarks*